United States Patent [19]

Gregoire et al.

[11] 4,413,662

[45] Nov. 8, 1983

[54] EDGING SYSTEM

[75] Inventors: James L. Gregoire, Decatur; Robert D. Wismer, Roswell; Robert L. Brouer, Conyers, all of Ga.

[73] Assignee: Forest Industries Machine Corp., Convers, Ga.

[21] Appl. No.: 271,601

[22] Filed: Jun. 8, 1981

[51] Int. Cl.[3] ..... B27B 1/00

[52] U.S. Cl. ..... 144/356; 83/367; 83/419; 83/520; 144/245 A; 144/246 E; 198/341; 198/345; 198/572

[58] Field of Search ..... 198/341, 345, 502, 572; 83/364, 367, 520, 365, 419, 278; 144/245 R, 356, 357, 245 A, 246 E, 242 H, 242 G

[56] References Cited

U.S. PATENT DOCUMENTS

| | | | |
|---|---|---|---|
| 1,804,764 | 5/1931 | Grant | 83/520 |
| 2,806,492 | 9/1957 | Becker | 83/520 |
| 3,983,403 | 9/1976 | Dahlstrom | 144/357 |
| 4,086,496 | 4/1978 | Berry | 144/357 |
| 4,120,333 | 10/1978 | Hellgren et al. | 144/242 G |
| 4,231,460 | 11/1980 | Heikinheimo | 144/357 |
| 4,240,477 | 12/1980 | Horn et al. | 144/245 R |
| 4,269,245 | 5/1981 | Fornell et al. | 144/356 |

*Primary Examiner*—W. D. Bray

*Attorney, Agent, or Firm*—B. J. Powell

[57] ABSTRACT

A system for orienting cants for edging by the side cutters in an edger including an infeed unit for moving the cant into the edger along a prescribed path; a manually controllable positioning assembly remotely of the infeed unit for selectively positioning the cant with respect to a positioning axis to preorient the cant with respect to the positioning axis; a sensing device operatively connected to the positioning assembly for sensing the position of the cant with respect to the positioning axis when the cant is preoriented with respect to the positioning axis; memory unit operatively connected to the sensing device for storing the sensed position of the cant with respect to the positioning axis; a conveyor for selectively moving the cant from the positioning assembly to the infeed unit; an infeed stop responsive to the sensed position stored in the memory unit to position the cant with respect to the edging path with the same orientation the cant had with respect to the positioning axis when the cant was preoriented. The method of positioning the cant is also disclosed.

9 Claims, 11 Drawing Figures

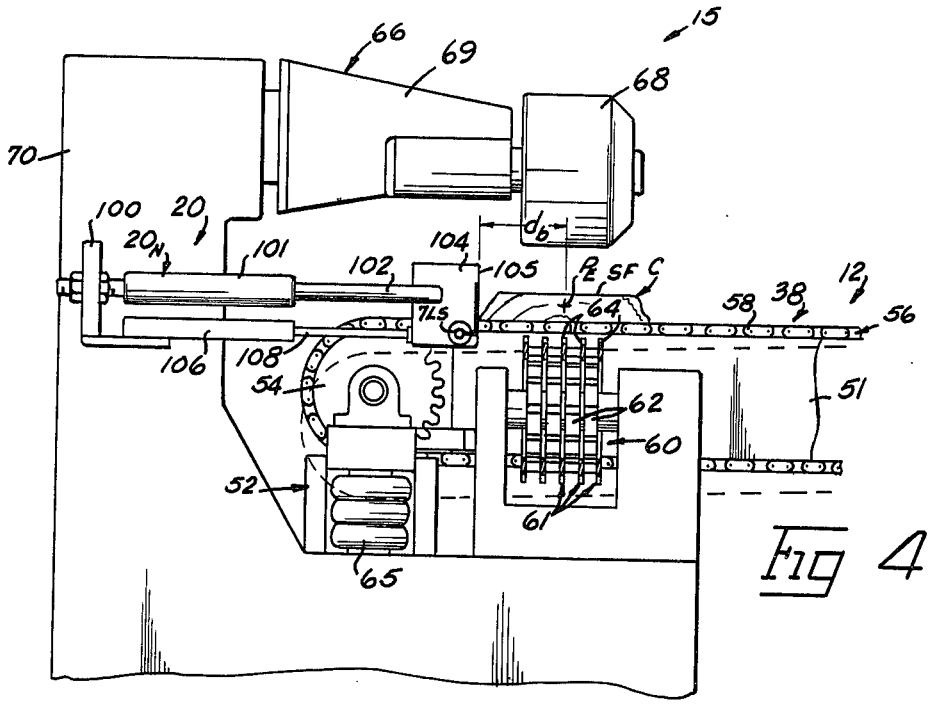
Fig 4
Fig 5
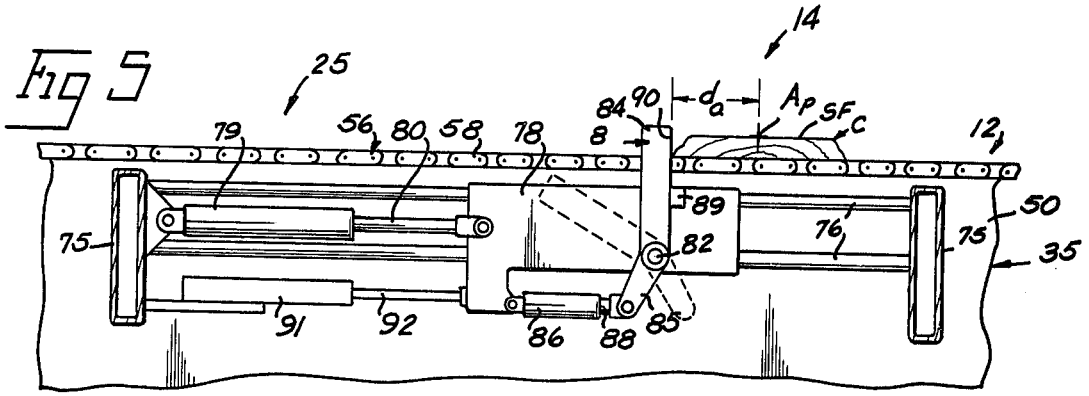
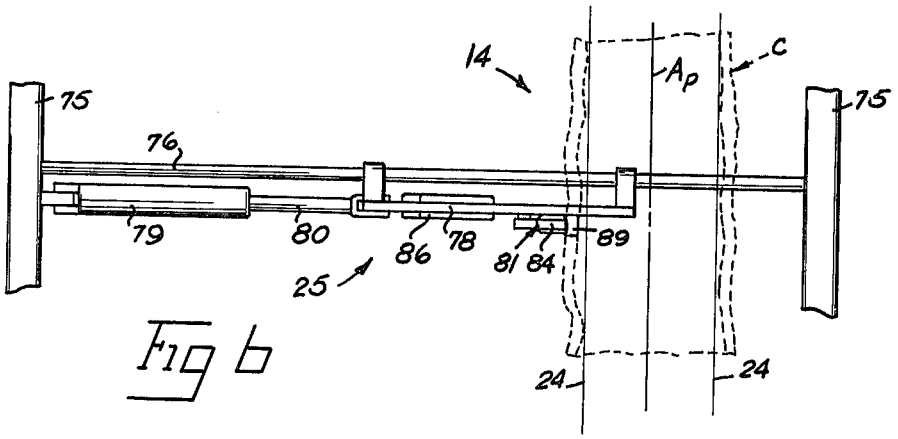
Fig 6

EDGING SYSTEM

BACKGROUND OF THE INVENTION

This invention relates generally to the manufacture of dimensioned lumber from sawn cants and more particularly to the orientation of sawn cants for edging operations.

In the manufacture of dimensioned lumber from trees, the tree is initially sawn with a series of longitudinally extending parallel cuts to divide the tree into cants. The resulting cants have opposed sawn faces parallel to each other with irregularly shaped wanes along opposite side edges of the cant. To form the cant into dimensioned lumber, it is necessary that these wanes be removed with edgers.

In typical edging operations, the cant is fed through the edger along a straight edging path with the edger making spaced apart cuts on opposite side edges of the cant parallel to the edging path to remove the wanes. The spacing between these parallel cuts is such that all of the wane is removed and the resulting lumber has a standard width. Because the wanes along opposite side edges of the cant have an irregular shape, the orientation of the cant with respect to the edging path affects the usable lumber yield from the cant after it has been edged. Therefore, it is necessary to orient the cant with respect to the edging path prior to entry of the cant into the edger to insure that all of the wane will be removed while at the same time the lumber yield from the cant will be maximized.

One prior art technique which has been used to orient the cant on the infeed unit uses a manually controlled orientation device on the infeed unit with which the operator orients the cant on the infeed unit after the cant has been fed thereonto. One of the problems associated with this prior art technique is that the operator must wait until the previously oriented cant has cleared the infeed unit before the next cant can be fed onto the infeed unit and then oriented. A significant amount of time is lost because the operator must wait until the cant is fed onto the infeed unit for orientation.

Another prior art technique which has been used to orient the cant on the infeed unit involves the use of an optical scanning device which scans the cant as to its size and shape and supplies the scanned information to a computer. The computer then determines the desired orientation of the cant with respect to the edging path to maximize the lumber yield from the cant and causes the cant to be oriented on the infeed unit using adjustable stops so that the cant has the desired orientation with respect to the edging path. While the technique of optically scanning the cant does have the capability of orienting the cant for maximum lumber yield and for operating sufficiently fast to minimize the time the cant is maintained on the infeed unit, the initial cost of such prior art systems has been sufficiently high that such systems have remained economically unfeasible except in very high speed edging operations. Moreover, because these prior art optical scanning systems have typically been unable to handle all possible cant configurations, an operator was still required to monitor the optical scanning system in order to orient those cants which could not be handled by the optical scanning system.

SUMMARY OF THE INVENTION

These and other problems and disadvantages associated with the prior art are overcome by the invention disclosed herein by providing a technique which permits the orientation of the cant with respect to the straight edging path through the edger at a position remote from the infeed unit with a manually controlled positioning mechanism. Thus, the operator can orient the cant at this remote position without having to wait while the previously oriented cant has cleared the infeed unit. The invention automatically reestablishes the remotely determined orientation of the cant with respect to the edging path on the infeed unit. As a result, the speed of operation of the invention is significantly greater than that associated with the prior art manually controlled orienting techniques while at the same time minimizes the initial capital costs of the invention so that the invention is economically feasible for a wide range of edging operations. Thus, the use of the operator's time is maximized while the speed of operation of the system is sufficient to supply a sufficient number of cants to the edger to maximize the utilization of the edger.

The apparatus of the invention includes a feed means for conveying the cant sidewise past a prepositioning station into an infeed unit for moving the cant lengthwise into an edger along a prescribed edging path to edge the cant. Manually controlled prepositioning stop means is provided at the prepositioning station to arrest the movement of the cant on the feed means and to preposition the cant with respect to a positioning axis extending lengthwise of the cant as established by a pair of guide light beams superimposed on the cant. Sensing means is provided for sensing the position of the leading edge of the cant with respect to the positioning axis and memory means is provided for storing the sensed position of the leading edge of the cant with respect to the positioning axis when the cant is prepositioned. Infeed stop means is provided in the infeed unit and responsive to the sensed position stored in the memory means to engage the cant moved into the infeed unit by the feed means to locate the leading edge of the cant with respect to the edging path corresponding to that of the cant in the prepositioning station when it was prepositioned. Holding means is provided between the prepositioning station and the infeed unit to selectively arrest the movement of the cant by the feed means to permit the next preceeding cant to clear the infeed unit before the cant is moved into the infeed unit.

The positioning stop means includes a near end prepositioning stop assembly for engaging the cant adjacent its near end and a plurality of far end prepositioning stop assemblies spaced along the length of the cant for engaging the cant adjacent the far end of the cant. Selection means is provided for selectively disabling the far end prepositioning stop assemblies so that only that far end prepositioning stop assembly closest to the far end of the cant engages the cant. The infeed stop means includes a near end infeed stop assembly for engaging the cant in substantially the same position as the near end prepositioning stop assembly and a plurality of far end infeed stop assemblies corresponding in position to the far end prepositioning stop assemblies. Selection detection means is provided for indicating which of the far end prepositioning stop assemblies was used to preposition the cant. The memory means stores the indication of the selection detection means and selector output means responsive to the stored indication enables that far end infeed stop assembly corresponding to the far end prepositioning stop assembly used to preposition the cant to position the far end of the cant with respect to the edging path in the infeed unit.

The method of the invention includes the steps of moving the cant to a positioning station remote to an infeed unit for an edger; arresting the movement of the cant in the positioning station; superimposing on the cant a plurality of parallel, spaced apart, guide light beams corresponding to the paths along which the edger will trim the cant to form dimensioned lumber; shifting the cant with respect to the guide light beams with a pair of spaced apart, manually controlled positioning mechanisms until the guide light beams lie inside the longitudinally extending wanes on opposite sides of the cant to orient the cant; sensing the position of each of the positioning mechanisms when the cant is oriented; storing the sensed position of each of the positioning mechanisms; moving the cant into the infeed unit; engaging the cant with a pair of spaced apart infeed stops at spaced apart positions corresponding to the positions at which the positioning mechanisms engaged the cant; and positioning each of the infeed stops according to the stored sensed position of the corresponding positioning mechanism to locate the cant on the infeed unit so that the infeed unit will feed the cant into the edger to cause the edger to trim the cant along the paths of the guide light beams at the positioning station when the cant was oriented. The method further includes the steps of adjustably positioning the spacing between the guide light beams so that the guide light beams will lie just inside the wanes on the cant in the positioning station; sensing the spacing between the guide light beams, storing the sensed spacing of the guide light beams; and setting the spacing between the side cutters in the edger according to the stored sensed spacing of the guide light beams prior to the infeed unit feeding the cant into the edger so that the edger will trim the cant along the paths of the light beams superimposed thereon at the positioning station when the cant was oriented.

These and other features and advantages of the invention disclosed herein will become more clearly understood upon consideration of the following description and accompanying drawings wherein like characters of reference designate corresponding parts throughout the several views and in which:

BRIEF DESCRIPTION OF THE DRAWINGS

FIG. 4 is an enlarged sectional view of the infeed unit of the invention taken generally normal to the edging path;

FIG. 5 is an enlarged side elevational view of one of the prepositioning assemblies;

FIG. 6 is a top view of the prepositioning assembly seen in FIG. 5;

Figure 1:
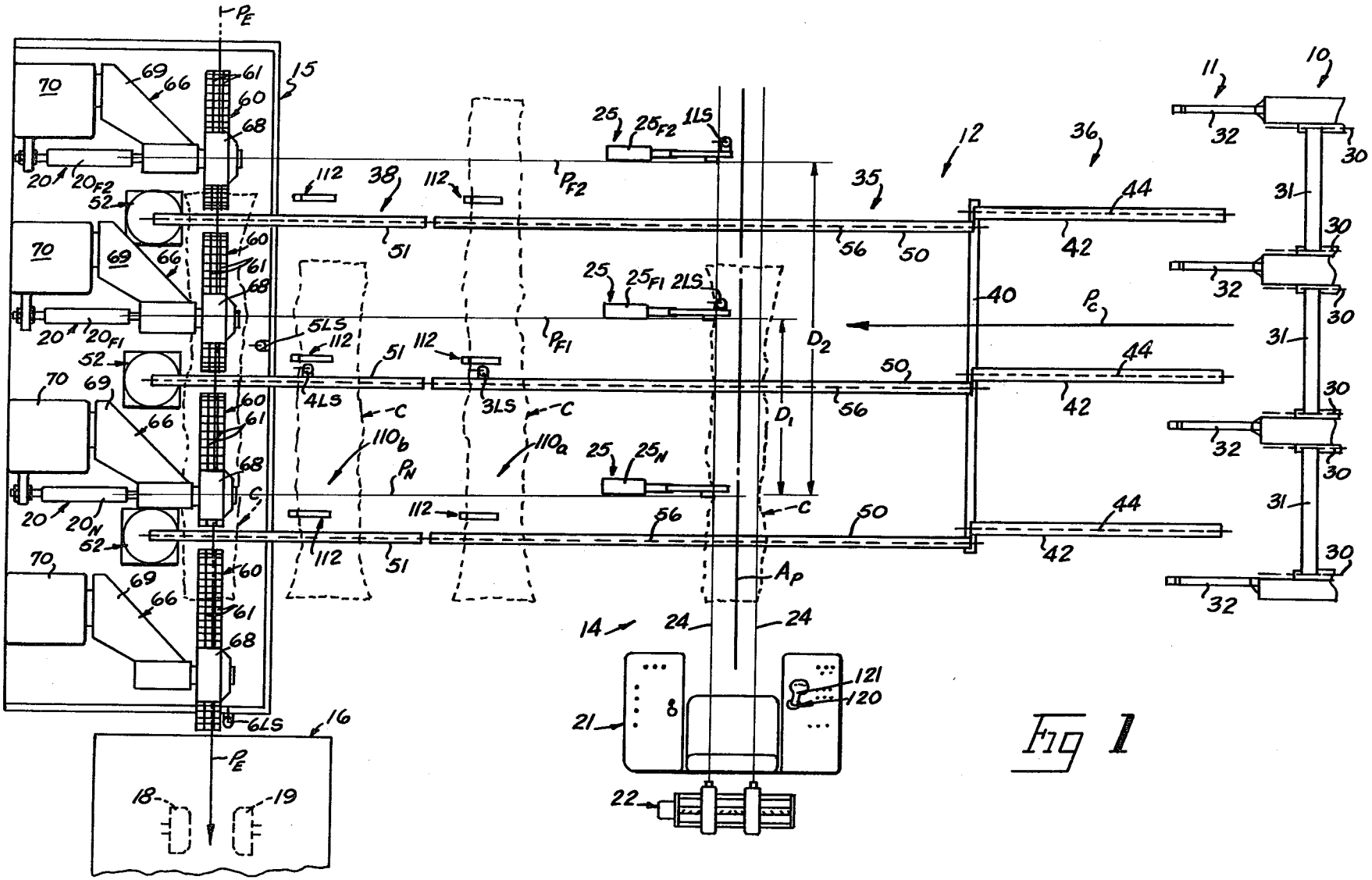
FIG. 1 is a top schematic view of an edging system incorporating the invention.

These figures and the following detailed description disclose specific embodiments of the invention; however, it is to be understood that the inventive concept is not limited thereto since it can be incorporated in other forms.

DETAILED DESCRIPTION OF ILLUSTRATIVE EMBODIMENTS

Referring to the drawings, it will be seen that the apparatus of the invention is incorporated in an edging system used to form dimensional lumber from cants sawn from a tree trunk. The edging system includes an unscrambler section 10 which feeds the cants individually sidewise to a turning unit 11. The cants are transferred from the turning unit 11 onto a feed table 12 which moves the cants sidewise through a prepositioning station 14 and subsequently into an infeed unit 15. The infeed unit 15 them moves the cant lengthwise into an edger 16 along a straight edging path $P_E$. As the cant is fed through the edger E, the edger trims opposite sides of the cant to remove the wane thereon.

The edger E operates conventionally and includes a pair of adjustable side cutters 18 and 19 positioned on oppposite sides of the edging path $P_E$ so that both cutters 18 and 19 are spaced equidistant from the edging path $P_E$. The side cutters 18 and 19 are incrementally adjustable to edge the cant to different standard widths. Typically, the spacing between side cutters 18 and 19 can be changed from four inches to twelve inches in two inch increments.

Because the infeed unit 15 feeds the cant into the edger 16 along the edging path $P_E$, it will be seen that positioning the cant in the infeed unit 15 with respect to the edging path $P_E$ causes this position to be maintained as the cant moves through edger 16. A plurality of adjustable infeed stop assemblies 20 are provided in the infeed unit 15 to position the cant with respect to the edging path $P_E$ as will become more apparent.

A control console 21 is provided on one side of the feed table 12 at the prepositioning station 14 so that the operator can look across the feed table 12 normal to the movement of the cant along the feed table. Since the cant is moving sidewise, the operator's view is longitudinally of the cant. A guide light assembly 22 is provided behind the console 21 so that a pair of spaced apart coherent light beams indicated at 24 are projected across the feed table 12 normal to the path of movement of the cant along the feed table. The guide light beams 24 are adjustably spaced apart the same distance as that of the side cutters 18 and 19 when the cant is being edged so that the operator can visually determine where the edger 16 will make the edging cuts on the cant as will become more apparent.

A plurality of prepositioning stop assemblies 25 are mounted in the feed table 12 at the prepositioning station 14 to selectively engage and position the cant with respect to the guide light beams 24 while it is located in station 14. The prepositioning stop assemblies 25 are under the control of the operator so that the cant can be shifted with respect to the guide light beams 24 until the wanes on the cant lie just outside the guide light beams 24. When this occurs, the operator disengages the stop assemblies 25 and allows the feed table 12 to move the cant onto the infeed unit 15. The settings of the prepositioning stop assemblies 25 are transferred to the infeed stop assemblies 20 in the infeed unit 15 so that the cant is located in the infeed unit 15 whereby the side cutters 18 and 19 will trim the cant along the positions indicated by the guide light beams 24. As soon as the cant is located in the infeed unit 15, the infeed unit 15 moves the cant into the edger 16 along the edging path $P_E$ to edge the cant.

Figure 3:
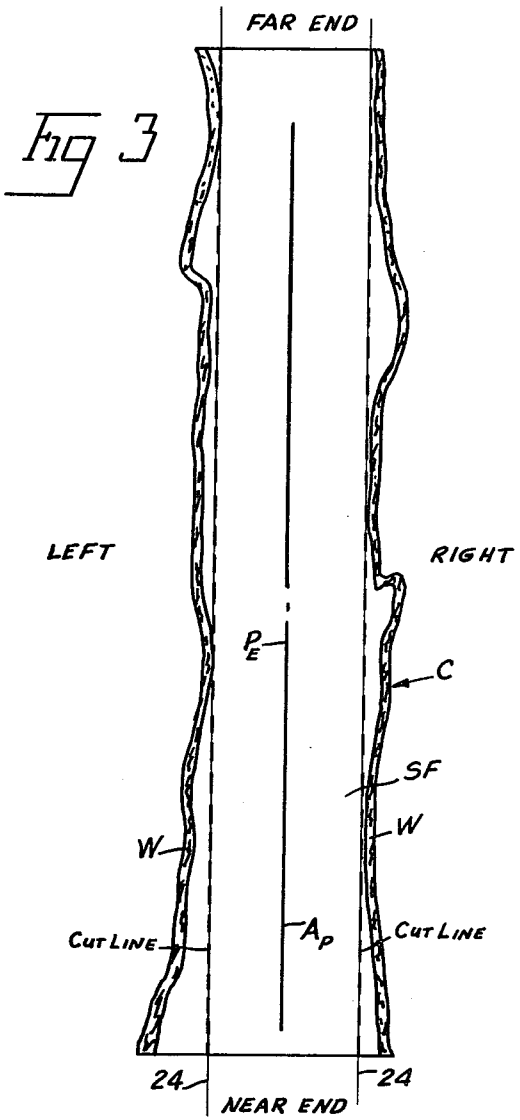
FIG. 3 is a view showing a typical cant with which the invention is used.

FIG. 3 illustrates a typical cant C which has been sawn from a tree trunk. The cant C has a pair of parallel spaced apart sawn faces SF forming the thickness of the cant and wanes W formed along opposite longitudinally extending side edges of the cant C. Typically, one of the sawn faces SF is narrower than the other because of the generally circular configuration of the tree trunk and this narrower sawn face SF is normally turned upwardly during the orientation of the cant for edging. FIG. 3 shows the narrower face SF turned up. To produce usable lumber, it will be seen that the cuts made along opposite side edges of the cant C need to remove the wanes W. At the same time, the cuts need to be spaced apart a maximum distance to maximize the lumber yield from the cant. This requires orienting the cant C so that the parallel side cuts pass just inside the wanes W as illustrated by dashed lines superimposed on the cant C seen in FIG. 3.

In the prepositioning station 14, the guide light beams 24 are projected onto the cant C with the same spacing therebetween as that the cutters 18 and 19 will have when the edger 16 edges the cant C. Thus, the cant C is oriented in the prepositioning station 14 so that the guide light beams 24 lie along the positions indicated by the dashed lines in FIG. 3. The guide light beams 24 are positioned equidistant on opposite sides of an imaginary positioning axis $A_P$ shown in FIG. 3. Thus, once the cant C has been positioned in the prepositioning station 14 so that the guide light beams 24 lie along the dashed lines in FIG. 3, the imaginary axis $A_P$ is established on the cant C. When the cant C is located in the infeed unit 15 so that the imaginary axis $A_P$ coincides with the edging path $P_E$, it will be appreciated that the cutters 18 and 19 will make cuts along the paths indicated by the dashed lines in FIG. 3 when the cant C passes through the edger 16. The invention is concerned with the orientation of the cant C in the prepositioning station 14 with respect to the guide light beams 24 to establish the imaginary positioning axis $A_P$ and then orienting the cant C in the infeed unit 15 so that the established positioning axis $A_P$ coincides with the positioning path $P_E$.

Figure 2:
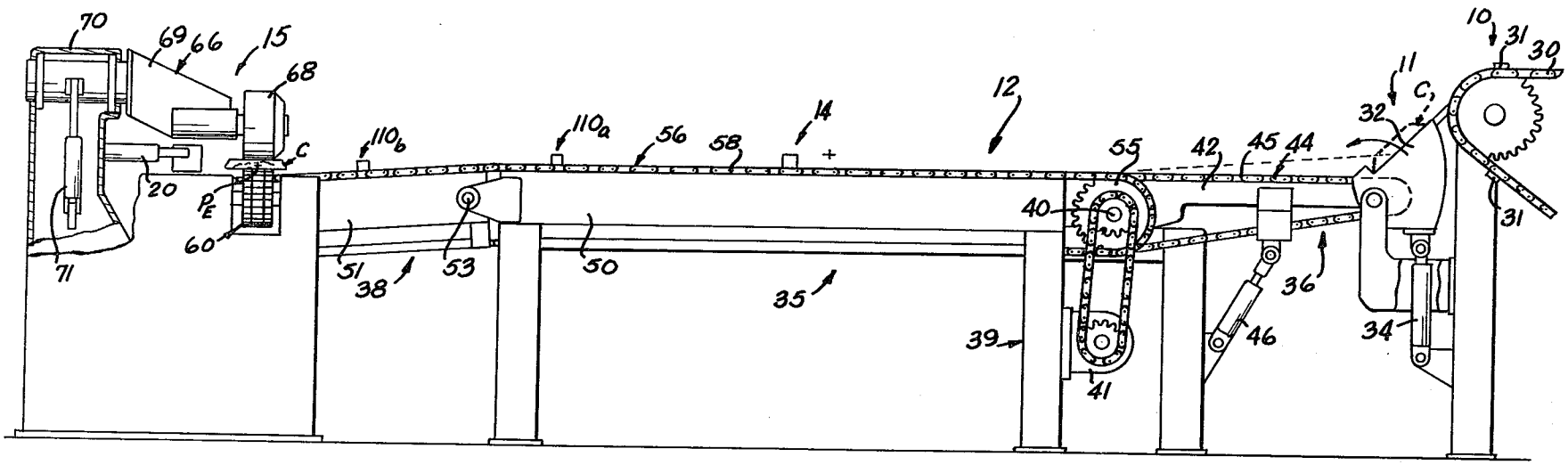
FIG. 2 is a side view thereof.

The unscrambler section 10 is of conventional construction and supplies the cants C one at a time to the turning unit 11. The unscrambler section 10 has a plurality of feed chains 30 with cross bars 31 as schematically seen in FIGS. 1 and 2 that individually move the cants C sidewise along the conveying path $P_C$ onto the turning unit 11. Appropriate conventional controls (not shown) are provided for the unscrambler section 10 so that only one cant will be located in the turning unit 11 as is well known in the art.

The turning unit 11 is also conventional and serves to selectively deposit the cant on the feed table 12 with either of the sawn flat surfaces on the cant facing upwardly. The turning unit 11 includes a plurality of quadrant plates 32 pivotally mounted adjacent the discharge end of the unscrambler section 10 so that the cant is supported thereon. A turn cylinder 34 is provided for pivoting the plates 32. When the plates 32 are pivoted, the cant is deposited on the feed table 12 with one side of the cant facing upwardly. When the feed table 12 removes the cant from the plates 32 without plates 32 being pivoted, the opposite side of the cant will be facing upwardly. This operation is conventional.

The feed table 12 includes a central fixed section 35, a jump section 36 on one end of the fixed section 35 adjacent the turning unit 11 and a discharge section 38 on the opposite end of the fixed section 35 for moving the cant into the infeed unit 15 as will become more apparent. The central section 35 includes a stationary support frame 39 which rotatably mounts a drive shaft 40 at that end of frame 39 connected to the jump section. The drive shaft 40 is driven by a motor 41. The jump section 36 includes a plurality of jump arms 42 pivotally mounted about the drive shaft 40 and projecting between the quadrant plates 32 in the turning unit 11. Each of the jump 42 mounts a jump chain 44 therearound with an upper flight 45 extending along the top of the arm 42. The jump chains 44 are driven from sprockets on drive shaft 40. The jump arms 42 are pivotally positioned by a jump cylinder 46 so that the upper flights of jump chains 44 can be lowered to the solid line position seen in FIG. 2 below the cant on the quadrant plates 32 in the turning unit 11 so that the cant will be maintained on quadrant plates 32. If the cant is to be transferred to the upper flights 45 of the jump chains 44 without the cant being turned over, the jump cylinder 46 is used to pivot the projecting ends of the jump arms 42 upwardly to the dashed line positions seen in FIG. 2 to raise the upper flights 45 of chains 44 into contact with the lower edge of the cant on the quadrant plates 32. This shifts the cant onto the upper flights 45 of chains 44 so that chains 44 move the cant sidewise away from the turning unit 11 along the conveying path $P_C$ as seen in FIG. 1. If the cant is to be turned over, the turn cylinder 34 is used to pivot the quadrant plates 32 while the jump chains 44 remain in their lowered position so that the cant is turned over as it falls off of the quadrant plates 32 onto the upper flights 45 of the jump chains 44.

The operation of the turn cylinder 34 in the turning unit 11 and the jump cylinder 46 in the jump section 36 is under the control of the operator at the control console 21. As will become more apparent, the cant is to be positioned on the upper flights 45 of the jump chains 44 so that the narrower sawn face is turned upwardly. Thus, the operator looks at the cant on the quadrant plates 32 to determine whether the narrower sawn face is turned upwardly. If this narrower sawn face is turned upwardly, the operator operates the jump cylinder 46 to raise jump chains 44 and remove the cant from the quadrant plates 32 without turning the cant over. If the narrower sawn face is turned downwardly, the operator operates the turn cylinder 34 to pivot the quadrant plates 32 to turn the cant over and deposit it on the jump chains 44 with the narrower sawn face facing upwardly.

The central section 35 includes a plurality of chain support rails 50 mounted on the support frame 39 oriented parallel to the conveying path $P_C$ and extending along the length of the central section. The discharge section 38 includes a plurality of pivot rails 51 with each of the pivot rails 51 pivoted at 53 to one of the support rails 50 opposite the jump section 36. The projecting end of each of the pivot rails 51 extends into the infeed unit 15 and is connected to a pivot assembly 52 seen in FIG. 4 so that the projecting ends of the pivot rails 51 can be raised and lowered as will become more apparent. Each of the pivot assemblies 52 mounts a sprocket 54 thereon in alignment with the pivot rail 51 and a similar sprocket 55 is mounted on the drive shaft 40 in alignment with that end of each of the support rails 50 opposite the pivot rails 51. A feed chain 56 is mounted around each of sprockets 54 and 55 with an upper flight 58 extending along the top of each support rail 50 and pivot rail 51. The feed chains 56 receive the cant on the upper flights 58 thereof and move the cant sidewise along path $P_C$ through the central section 35 and discharge section 38 of the feed table 12 into the feed unit 15. Those portions of the upper flights 58 of feed chains 56 supported on the support rails 50 remain horizontally oriented while those portions supported on the pivot rails 51 move therewith so that the cant will be transported into the infeed unit 15 when the pivot rails 51 are raised and deposited in the infeed unit 15 when the pivot rails 51 are lowered as will become more apparent.

The infeed unit 15 includes a plurality of infeed chain assemblies 60 arranged along the edging path $P_E$ through the infeed unit 15 with the edging path $P_E$ oriented normal to the conveying path $P_C$. Each of the infeed chain assemblies 60 includes a plurality of spiked infeed chains 61 trained around spaced apart sprockets 62 seen in FIG. 4 so that the upper flights 64 of chains 61 lie in a horizontal plane and move along paths parallel to the edging path $P_E$. It will be noted in FIG. 1 that a space is defined between the ends of the infeed chain assemblies 60 sufficient for the pivot rails 51 and the feed chains 56 thereon to freely pass between adjacent infeed chain assemblies 60. The infeed chain assemblies 60 are arranged so that the upper flights 64 of all of the infeed chains 61 lie in a common horizontal plane. The pivot assemblies 52 for the pivot rails 51 are mounted in the infeed unit 15 behind the infeed chain assemblies 60 and each is equipped with a lift device 65 illustrated as an air bag lift in FIG. 4 which raises the upper flights 58 of the feed chains 56 above the level of the upper flights 64 of the infeed chains 61 when a cant is being transferred into the infeed unit 15 from the feed table 12 and which lowers the upper flights 58 on the feed chains 56 below the upper flights 64 on the infeed chains 61 after the cant has been located in the infeed unit 15 as will become more apparent to deposit the cant onto the upper flights 64 of the infeed chains 61.

A plurality of hold down roll assemblies 66 are provided on the infeed unit 15 to force the cant down into driving contact with the infeed chains 61. The infeed chains 61 are conventionally driven to move the cant into the edge 16 along the edging path $P_E$. The hold down roll assemblies each include a hold down roll 68 rotatably mounted on an arm 69 pivoted on a stand 70 so that the roll 68 is in vertical registration with the infeed chains 61 thereunder. A hold down cylinder 71 seen in FIG. 2 is connected to the arm 69 to selectively pivot the arm 69 downwardly to cause the hold down roll 68 to force the cant onto the infeed chains 61 and to pivot the arm 69 upwardly to raise the hold down roll 68 so that a cant can be moved between the chains 61 and roll 68 by the feed chains 56.

The prepositioning station 14 is located at the central section 35 of the feed table 12. The guide light assembly 22 is oriented so that the guide light beams 24 project across the feed table 12 normal to the conveying path $P_C$. Thus, it will be seen that the imaginary positioning axis $A_P$ extends across table 12 normal to the conveying path $P_C$. The light assembly 12 is located so that the positioning axis $A_P$ remains fixed axially of the table 12 while the guide light beams 24 can be incrementally shifted laterally of the axis $A_P$ to adjust for different settings between the cutters 18 and 19 in the edger 16. This adjustment of the light beams 24 is under the control of the operator at console 21.

The prepositioning stop assemblies 25 are mounted on the central section 35 of the feed table 12 and serve to arrest the movement of a cant being moved along the conveying path $P_C$ by the feed chains 58 under th axis $A_P$ so that the light beams 24 will be projected onto the upwardly facing sawn surface of the cant. The prepositioning stop assemblies 25 have the same construction and only one will be described in detail.

The prepositioning stop assembly 25 as seen in FIGS. 5 and 6 is mounted on cross members 75 extending between the support rails 50. A pair of spaced apart slide rods 76 extend between the cross members 75 and slidably mount a slide plate 78 thereon so that slide plate 78 is slidably movable along a path normal to the positioning axis $A_P$ and lies below the upper flights 58 of feed chains 56.

The slide plate 78 is positioned along slide rods 76 by a positioning cylinder 79 mounted on one of the cross members 75 with its piston rod 80 connected to the slide plate 78. In the configuration illustrated, extension of piston rod 80 moves slide plate 78 toward axis $A_P$ and retraction of piston rod 80 moves plate 78 away from axis $A_P$. A position stop 81 is pivotally mounted intermediate its ends at 82 on slide plate 78 with a stop end 84 adapted to extend above the slide plate and a drive end 85 projecting therebelow. The stop 81 is pivotally positioned by a drop cylinder 86 connected to the slide plate 78 with its piston rod 88 connected to the drive end 85 of stop 81. The cylinder 86 is adapted to pivot the stop 81 between an arresting position shown by solid lines in FIG. 5 against an abutment 89 of slide plate 78 and a release position shown by dashed lines in FIG. 5. In the arresting position, the end 84 projects above the level of the upper flights 58 on feed chains 56 to engage the leading edge of the cant as it is moved by chains 56. The chains 56 continue to move under the cant while it is held by stops 81 to keep the leading edge of the cant abutted up against stops 81. When the drop cylinder 86 pivots the stop 81 to its release position, the stop end 84 on stop 81 is moved below the level of the upper flights 58 on feed chains 56 so that the feed chains 56 can move the cant over stops 81 toward the infeed unit 15. After the cant passes over the stops 81, the stops 81 are returned to their arresting positions to arrest the movement of the next cant moved into the prepositioning station 14 from the jump section 36.

The positioning cylinder 79 is operated while the stop 81 is in its arresting position to selectively vary the distance $d_a$ between the leading edge 90 on the stop end 84 of sttop 81 and the positioning axis $A_P$. This serves to move the cant abutting stop 81 with respect to axis $A_P$ and the guide light beams 24. As will become more apparent, the positioning cylinder 79 is under the control of the operator. This allows the operator to operate positioning cylinder 79 until the guide light beams 24 lie inside the wanes on the cant. To sense the position of the leading edge 90 on stop 81 with respect to axis $A_P$, a linear voltage dividing transducer 91 is mounted on the cross member 75 and its actuator 92 is connected to slide plate 78 so that the slide plate 78 moves the actuator 92 with respect to the transducer 91 as the cylinder 79 moves slide plate 78 to linearly vary the output of the transducer 91. Thus, it will be seen that the output of the transducer 91 is indicative of the distance $d_a$ between the leading edge 90 on stop 81 and the axis $A_P$. When the positioning cylinder 79 has moved the cant so that the guide light beams 24 lie just inside the wanes on the cant, it will likewise be seen that the leading edge of the cant at the point it is engaged by the stop 81 is spaced the distance $d_a$ from the positioning axis $A_P$. Because of this, the output of transducer 91 is also indicative of the distance between the leading edge of the cant and the axis $A_P$.

As the cant is moved across the feed table 12, one end of the cant will be adjacent the operator in the prepositioning station 14. For sake of clarity, this end of the cant will be referred to as the near end and the opposite end as the far end. It will also be appreciated that the lengths of the cants may vary but the near end of the cant is located at about the same position with respect to the operator. For best positioning of the cant, it is desirable that the cant be engaged by the prepositioning stop assemblies 25 as close as practical to the opposite ends of the cant. One of the prepositioning stop assemblies 25 is positioned adjacent the near end of the cants and is designated $25_N$. The prepositioning stop assembly $25_N$ is used in positioning all of the cants. To engage the far end of different length cants, a plurality of the prepositioning stop assemblies 25 are provided and spaced from the near end prepositioning stop assembly $25_N$ by different distances. The closest far end prepositioning stop assembly is designated $25_{F1}$ and is spaced the distance $D_1$ along axis $A_P$ from the near end prepositioning stop assembly $25_N$ as seen in FIG. 1. Another far end prepositioning stop assembly designated $25_{F2}$ is spaced the distance $D_2$ along axis $A_P$ from the near end positioning assembly $25_N$ where distance $D_2$ is greater than distance $D_1$. As will become more apparent, the far end prepositioning stop assemblies $25_{F1}$ and $25_{F2}$ are selectively utilized so that the far end prepositioning stop assembly $25_{F1}$ or $25_{F2}$ nearer the far end of the cant will be used in the positioning of the cant as will become more apparent. Thus, it will be seen that the near end prepositioning stop assembly $25_N$ will be used in combination with one of the far end prepositioning stop assemblies $25_{F1}$ or $25_{F2}$ to position the cant in the prepositioniing station 14. For instance, if the length of the cant is such that the far end of the cant can be engaged by assembly $25_{F1}$ but not by the assembly $25_{F2}$, then the far end prepositioning stop assembly $25_{F1}$ is used in combination with the near end prepositioning stop assembly $25_N$ to position the cant. On the other hand, if the cant is sufficiently long to be engaged by prepositioning stop assembly $25_{F2}$ as well as prepositioning stop assembly $25_{F1}$, then the far end prepositioning stop assembly $25_{F2}$ is used in combination with the near end prepositioning stop assembly $25_N$ to position the cant. It will also be understood that additional far end prepositioning stop assemblies may be provided to handle additional lengths of cants where the far end prepositioning stop assembly located furthest from the near end prepositioning stop assembly $25_N$ which will engage the cant will be used in combination with the near end prepositioning stop assembly $25_N$ to position the cant in the prepositioning station 14.

The infeed stop assemblies 20 correspond in number to the prepositioning stop assemblies 25 with each of the infeed stop assemblies 20 corresponding to one of the stop assemblies 25. Thus, as seen in FIG. 1, there is a near end infeed stop assembly $20_N$ corresponding to the near end prepositioning stop assembly $25_N$ which is located in direct alignment with assembly $25_N$ along a path $P_N$ parallel to the conveying path $P_C$, a far end infeed stop assembly $20_{F1}$ corresponding to the prepositioning stop assembly $25_{F1}$ which is located in direct alignment with assembly $25_{F1}$ along path $P_{F1}$ parallel to conveying path $P_C$, and a far end infeed stop assembly $20_{F2}$ corresponding to the far end prepositioning stop assembly $25_{F2}$ which is in direct alignment with the assembly $25_{F2}$ along path $P_{F2}$ parallel to conveying path $P_C$. Because of this alignment and because the feed chains 56 move the cant along the conveying path $P_C$, each infeed stop assembly 20 will engage the leading edge of the cant at substantially the same position along the length of the cant that its corresponding prepositioning stop assembly 25 engages the leading edge of the cant.

All of the infeed stop assemblies 20 have the same construction and only one will be described in detail. The infeed stop assembly 20 as seen in FIG. 4 is mounted on a support bracket 100 on one of the stands 70 in the infeed unit 15. Thus, the bracket 100 is fixed with respect to the edging path $P_E$. The infeed stop assembly 20 includes a stop cylinder 101 fixedly mounted on the support bracket 100 and projecting toward the edging path $P_E$. The piston rod 102 of cylinder 101 projects therefrom toward path $P_E$ and mounts an infeed stop 104 on the projcting end thereof. The cylinder 101 is oriented so that the piston rod 102 moves stop 104 along a horizontal path normal to the edging path $P_E$ and parallel to the conveying path $P_C$ so that the movement of the stop 104 in infeed stop assembly 20 is in alignment with the movement of the stop 81 in the corresponding prepositioning stop assembly 25. The infeed stop assembly 20 is located on the same side of the edging path $P_E$ as the prepositioning stop assembly 25 is located with respect to the positioning axis $A_P$ so that the stop 104 engages the leading edge of the cant the same as stop 81 in prepositioning stop assembly 25.

When the feed chains 56 move the cant into the infeed unit 15 over the infeed chain assemblies 60, the leading edge of the cant will be engaged by the leading abutment edge 105 on the infeed stop 104 to arrest the movement of the cant along the conveying path $P_C$ by feed chains 56 and thus locate the cant in the infeed unit 15. It will further be appreciated that, when the leading abutment edge 105 on stop 104 is located the same distance from the edging path $P_E$ as that of the leading edge 90 on prepositioning stop 81 from the axis $A_P$ in the prepositioning station 14, the movement of the cant on feed chains 56 will be arrested so that the cant is located with respect to the infeed path $P_E$ the same as it was located with respect to the axis $A_P$ in the prepositioning station.

To sense the position of the leading edge 105 on infeed stop 104 with respect to the edging path $P_E$, a linear voltage dividing transducer 106 is mounted on the support bracket 100 and its actuator 108 is connected to the stop 104 so that stop 104 moves the actuator 108 with respect to transducer 106 as the cylinder 101 moves stop 104 to linearly vary the output of transducer 106. Thus, it will be seen that the output of transducer 106 is indicative of the distance $d_b$ between the edging path $P_E$ and the leading edge 105 on stop 104. The transducer 106 is further arranged so that when the distance $d_b$ between stop 104 and path $P_E$ is equal to the distance $d_a$ between stop 81 and axis $A_P$ in the corresponding prepositioning stop assembly 25, the output of the transducer 106 in the infeed stop assembly 20 will be equal to the output of the transducer 91 in the prepositioning stop assembly 25. Therefore, to locate the cant with respect to the edging path $P_E$ in the infeed unit 15 the same as it was located with respect to axis $A_P$ in the prepositioning station 14, the stop 104 is moved until the output of the transducer 106 equals that of the transducer 91 in the prepositioning stop assembly 25.

To locate the cant in the infeed unit 15, those infeed stop assemblies 20 corresponding to the prepositioning stop assemblies 25 used to position the cant in the prepositioning station 14 will be used.. Thus, if stop assemblies $25_N$ and $25_{F1}$ are used in station 14, then stop assemblies $20_N$ and $20_{F1}$ in the infeed unit 15 will be used, and if stop assemblies $25_N$ and $25_{F2}$ are used in station 14, then stop assemblies $20_N$ and $20_{F2}$ in the infeed unit 15 will be used. This allows the operator to preposition the cant in the prepositioning station 14 remotely of feed unit 15 and the cant to be automatically repositioned in the infeed unit 15 with the same position it had in the prepositioning station 14 so that the operator can be prepositioning another cant in the prepositioning station 14 while the prepositioned cant is being automatically positioned in the infeed unit 15. As a result, the speed of operation of the edging system can be maximized.

It may be desirable to accumulate cants between the prepositioning station 14 and the infeed unit 15 and then successively more the accumulated cants into the infeed unit 15 in order to minimize the time required to move each cant into the infeed unit 15. To provide for this accumulation, a plurality of hold stations $110_a$ and $110_b$ are provided between the prepositioning station 14 and the infeed unit 15. While two holding stations are illustrated, as many holding stations as desired may be provided without departing from the scope of the invention. Each of the hold stations $110_a$ and $110_b$ includes a plurality of hold stop assemblies 112 spaced across the feed table 12 along a line normal to the conveying path $P_C$. The hold stop assemblies 112 can be selectively raised to engage the cant on the feed chains 56 and arrest its movement along path $P_C$ or lowered so that the chains 56 will move the cant thereby. Thus, the cant is moved from the prepositioning station 14 to the hold station $110_a$, then to hold station $110_b$, and finally into the infeed unit 15. As will become more apparent, the hold stations are operated so that each cant will be held in the hold station $110_b$ nearest the infeed unit 15 until the immediately preceding cant has cleared the infeed unit 15 and then releases the cant so that it will be moved to the infeed unit 15 by the feed chains 56. Each cant will be held in hold station $110_a$ until the immediately preceding cant has cleared the hold station $110_b$ and then releases the cant to be moved to hold station $110_b$ by feed chains 56.

Figure 7:
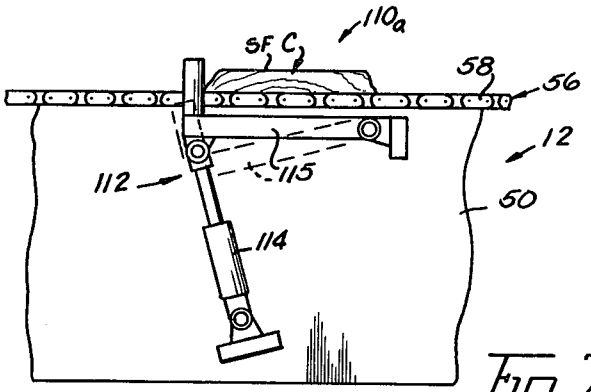
FIG. 7 is an enlarged side elevational view of one of the hold stop assemblies.

All of the hold stop assemblies 112 have the same construction and only one will be described in detail. The hold stop assembly 112 in hold station $110_a$ as seen in FIG. 7 includes a holding stop 115 pivoted on a support carried by support rail 50. A hold cylinder 114 is connected to stop 115 to selectively raise the stop above the upper flights 58 of feed chains 56 as shown in solid lines in FIG. 7 to engage the leading edge of the cant and to selectively lower the stop to the dashed line position seen in FIG. 7 below the upper flights 58 to release the cant for movement thereby by the feed chains 56.

To sense the presence of the cant at the prepositioning station 14, the far end prepositioning stop assembly $25_{F2}$ is provided with a limit switch 1LS which is transferred when the cant is present at stop assembly $25_{F2}$ and the stop assembly $25_{F1}$ is provided with a limit switch 2LS which is transferred when the cant is present at stop assembly $25_{F1}$ as schematically shown in FIG. 1. To sense the presence of the cant at the hold station $110_a$, a limit switch 3LS is provided adjacent one of the stop assemblies 112 therein; to sense the presence of the cant at the hold station $110_b$, a limit switch 4LS is provided adjacent one of the stop assemblies 112 therein also seen in FIG. 1. A limit switch 5LS is provided at the entrance of the infeed unit 15 to detect when the cant enters the infeed unit 15.

Each of the infeed stop assemblies 20 is provided with a limit switch to detect when the cant has abutted against the leading edge 105 on the infeed stop thereof as seen in FIG. 4. To distinguish between the different infeed stop assemblies, the limit switch associated with the near end infeed stop assembly $20_N$ seen in FIG. 4 is designated 7LS, the limit switch associated with the far end infeed stop assembly $20_{F1}$ will be designated 8LS in the control circuit, and the limit switch associated with the far end infeed stop assembly $20_{F2}$ will be designated 9LS in the control circuit.

To detect the presence of a cant being moved from the infeed unit 15 into the edger 16, a limit switch 6LS seen in FIG. 1 is provided at the discharge end of the infeed unit 15. It is to be understood that different types of detection devices such as photoelectric cells may be used in lieu of the limit switches without departing from the scope of the invention.

Figure 8:
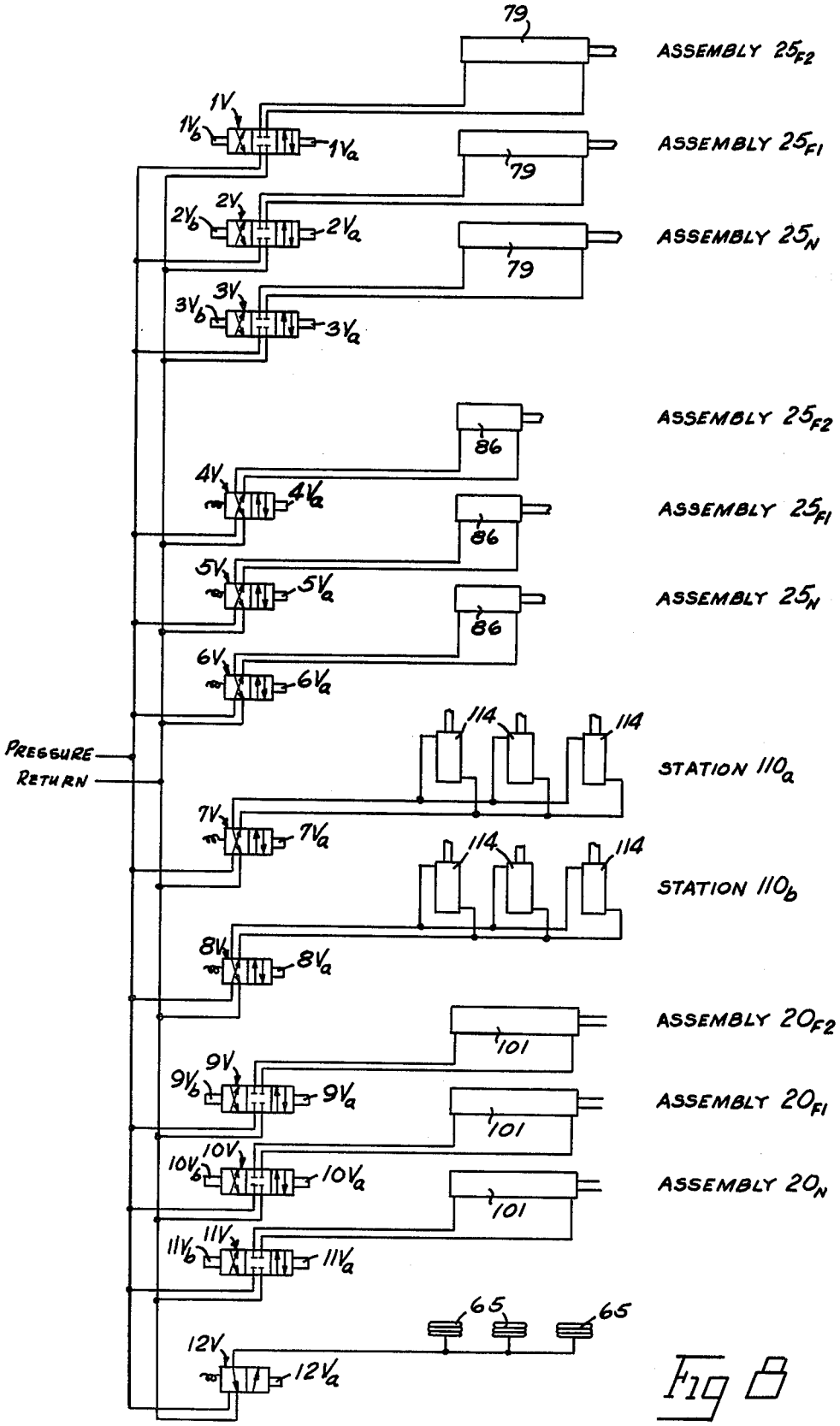
FIG. 8 is a fluid schematic illustrating the control of the invention.

As best seen in the fluid control schematic of FIG. 8, the positioning cylinder 79 in the far end prepositioning stop assembly $25_{F2}$ is controlled by solenoid valve 1V, positioning cylinder 79 in the far end prepositioning stop assembly $25_{F1}$ is controlled by solenoid valve 2V, and the positioning cylinder 79 in the near end prepositioning stop assembly $25_N$ is controlled by the solenoid valve 3V. Each of the valves 1V–3V is a three-position valve with a normal blocking position seen in FIG. 8 in which the piston rod in the cylinder is maintained in a fixed position, a first transferred position to which the valve is shifted when one of the solenoids thereon is energized, and a second transferred position to which the valve is shifted when the other solenoid thereon is energized. The solenoids on each of the valves 1V–3V are identified by the number of the valves with the subscripts "a" and "b" where the solenoids with the subscripts "a" serve to extend the piston rods of the control cylinders 79 while the solenoids with the subscript "b" serve to retract the piston rods of the control cylinders 79. Thus, it will be seen that the stop 81 in each of the prepositioning stop assemblies 25 can be moved toward the positioning axis $A_P$ (to the right as seen in FIG. 1) by energizing the solenoid on its associated valve with the subscript "a" moved away from the axis $A_P$ (to the left as seen in FIG. 1) by energizing the solenoid on its associated valve identified with the subscript "b".

The drop cylinder 86 in the far end prepositioning stop assembly $25_{F2}$ is positioned by solenoid valve 4V, the drop cylinder 86 in the far end prepositioning stop assembly $25_{F1}$ is positioned by solenoid valve 5V, and the drop cylinder 86 in the near end prepositioning stop assembly $25_N$ is positioned by the solenoid valve 6V. Each of the solenoid valves 4V–6V are two-position valves which are spring urged toward a normal position seen in FIG. 6 so that fluid under pressure supplied to the rod ends of the cylinders 86 to retract the piston rod 88 and, thus, raise the stop 81 associated therewith to its arresting position. Each of the valves 4V–6V is provided with a solenoid identified by the valve number with the subscript "a" which serves to shift the valve to a transferred position to cause the drop cylinder 86 associated therewith to extend its piston rod 88 and move the stop 81 to its release position.

All of the fluid cylinders 114 in the hold station $\mathbf{110}_a$ are controlled by a two-position solenoid valve 7V which is spring urged toward a normal position to extend the piston rods of the fluid cylinders 114 and raise the stops 115 controlled thereby to a position to arrest the movement of the cant along the path $P_C$. The valve 7V is provided with a solenoid $\mathbf{7V}_a$ which moves the valve 7V to a transferred position to retract the piston rods associated with the fluid cylinders 114 and lower the stops 115 associated therewith to allow the cant to move out the hold station $\mathbf{110}_a$ on feed chains 56. All of the fluid cylinders 114 in the hold station $\mathbf{110}_b$ are controlled by a solenoid valve 8V. The valve 8V is a two-position valve spring urged toward its normal position seen in FIG. 8 to extend the piston rods of the fluid cylinders 114 and raise the stops 115 controlled thereby to a position arresting the movement of the cant along the path $P_C$. Valve 8V has a solenoid $\mathbf{8V}_a$ which moves the valve to a transferred position to lower the stops 115 associated therewith to a release position by retracting the piston rods associated with the fluid cylinders 114 to allow the cant to pass out of the hold station $\mathbf{110}_b$ on feed chains 56.

As also seen in FIG. 8, the stop cylinder 101 in the far end infeed stop assembly $\mathbf{20}_{F2}$ is positioned by solenoid valve 9V, the stop cylinder 101 in the far end infeed stop assembly $\mathbf{20}_{F1}$ is positioned by solenoid valve 10V, and the stop cylinder 101 in the near end infeed stop assembly $\mathbf{20}_N$ is positioned by solenoid valve 11V. Each of the valves 9V–11V is a three-position solenoid valve having a normal blocking position fixing the piston rod with respect to the fluid cylinder with one solenoid for transferring the valve to a first position to extend the piston rod 102 of the associated stop cylinder 101 and another solenoid for transferring the valve to a second position to retract the piston rod 102 of the associated stop cylinder 101. That solenoid which extends the piston rod has been identified by the valve number with the subscript "a" for each of the valves 9V–11V and that solenoid which retracts the piston rod has been identified by the valve number with the subscript "b". Thus, it will be seen that the stop 104 in each of the infeed stop assemblies 20 can be moved toward the eding path $P_E$ (to the right as seen in FIG. 1) by energizing the solenoid on its associated valve with the subscript "a" and moved away from path $P_E$ (to the left in FIG. 1) by energizing the solenoid on its associated valve with the subscript "b".

Solenoid valve 12V operates the lift devices 65 to control the raising and lowering of the pivot rails 51. Valve 12V is a two-position valve which is spring urged toward a normal position seen in FIG. 8 to bleed fluid from the lift devices 65 and lower pivot rails 51 so that the upper flights 58 of the feed chains 56 thereon lie below the level of the upper flights 64 of the infeed chains 61. Valve 12V has a solenoid $\mathbf{12V}_a$ to shift the valve to a transferred position to supply fluid under pressure to the lift devices 65 and raise the pivot rails 51 so that the upper flights 58 of feed chains 56 thereon lie above the level of the upper flights 64 of the infeed chains 61.

The valves 1V–3V are under the control of the operator to selectively move the cant with respect to the positioning axis $A_P$ in the prepositioning station 14. After the leading edge of the cant has abutted against the stops 81 in the prepositioning assemblies 25, the operator can adjust the valves 1V–3V to move stops 81 while the feed chains 56 maintain the cant abutted against the stops 81 so that the cant is effectively positioned by the prepositioning assemblies 25. The valves 4V–6V are under the control of the operator so that the operator can keep the cant in the prepositioning station 14 until the cant has been prepositioned with respect to the positioning axis $A_p$. If the hold station $\mathbf{110}_a$ is clear when the prepositioning of the cant is completed in prepositioning station 14, then stop 81 is moved to the release position to allow feed chains 56 to move the cant to the hold station $\mathbf{110}_a$.

The valves 7V and 8V are automatically controlled so that when a cant has cleared the infeed unit 15, the valve 8V will be operated to release the cant held in the holding station $\mathbf{110}_b$ so that it will be moved into the infeed unit 15 by the feed chains 56. Likewise, the valve 7V is automatically operated so that when a cant has cleared the hold station $\mathbf{110}_b$, the valve 7V will be operated to release the cant in the hold station $\mathbf{110}_a$ so that it can move into the hold station $\mathbf{110}_b$.

The valves 9V–11V are automatically controlled as will become more apparent to position the cant in the infeed unit 15 with respect to the edging path $P_E$. The valves 9V–11V are automatically operated by the control circuits as will be explained so the cant will have the same position with respect to path $P_E$ that it had with respect to the positioning axis $A_p$ in the prepositioning station when the prepositioning of the cant was completed.

The valve 12V is also automatically operated. When the cant enters the infeed unit 15, the lift devices 65 are raised to raise the feed chains 56 above the infeed chains 61 in the infeed unit 15 so that the cant will be moved into position in the infeed unit 15.

The operation of the prepositioning stop assemblies 25 in the prepositioning station 14 are controlled by a single stick controller 120 seen in FIG. 1 on the control console 21. The controller 120 has a manually engageable handle 121 which is grasped by the operator to move the handle to different positions that control the prepositioning stop assemblies 25. Such controllers 120 are commercially available under the trade name "Dynamaster" from Kockums Industries. Controller 100 has a trigger switch TS schematically illustrated in FIG. 10 on the handle which is operated by the operator pressing thereon and effectively has four output switches $SW_1$–$SW_4$ also schematically illustrated in FIG. 10 controlled by the position of the handle 121 as will become more apparent.

Figure 9:
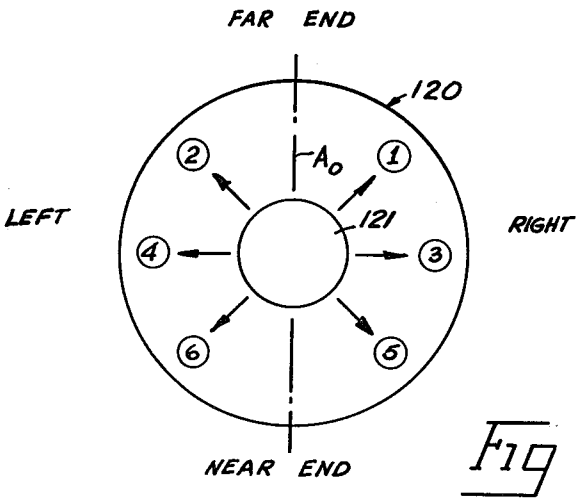
FIG. 9 is a functional schematic view illustrating the operation of the controller used in the invention.

To better understand the operation of the output switches $SW_1$–$SW_4$ of the controller 120, a schematic representation of the controller 120 is illustrated in FIG. 9. It will be seen that the controller 100 is oriented so that its operating central axis $A_O$ is oriented on the control console 21 to be generally parallel to the prepositioning axis $A_p$ on the feed table 12 at the prepositioning station 14. The controller 120 is further oriented so that one end of the axis $A_O$ corresponds to the far end of the cant in the prepositioning station 14 while the other end corresponds to the near end of the cant. These have been appropriately labelled for identification in FIG. 9. It will be seen that the control handle 121 can be moved toward any one of six positions which have been labelled "1"–"6". Switches $SW_1$–$SW_4$ are connected to the control handle 121 so that, when the handle 121 is moved toward position "1", the switch $SW_1$ will be closed; and when the handle 121 is moved toward position "2", the switch $SW_2$ will be closed. When the handle 121 is moved toward position "5", the switch $SW_3$ will be closed; and when the handle 121 is moved toward position "6", the switch $SW_4$ will be closed. When the handle 121 is moved toward position "3", switches $SW_1$ and $SW_3$ will both be closed; and when the handle 121 is moved toward position "4", switches $SW_2$ and $SW_4$ will both be closed. As will become more apparent, switches $SW_1$ and $SW_2$ are used to control the far end prepositioning stop assemblies $\mathbf{25}_{F1}$ and $\mathbf{25}_{F2}$ so that movement of the handle 121 toward positions "1" and "2" individually controls the far end positioning assemblies. The switches $SW_3$ and $SW_4$ are used to control the near end prepositioning stop assembly $\mathbf{25}_N$ so that movement of the handle 121 toward positions "5" and "6" individually controls the near end prepositioning stop assembly $\mathbf{25}_N$. Likewise, it will be appreciated that movement of the handle 121 toward positions "3" and "4" simultaneously positions both the near end prepositioning stop assembly $\mathbf{25}_N$ and the far end prepositioning stop assembly $\mathbf{25}_{F1}$ or $\mathbf{25}_{F2}$ being used to orient the cant in the prepositioning station 14.

Figure 10:
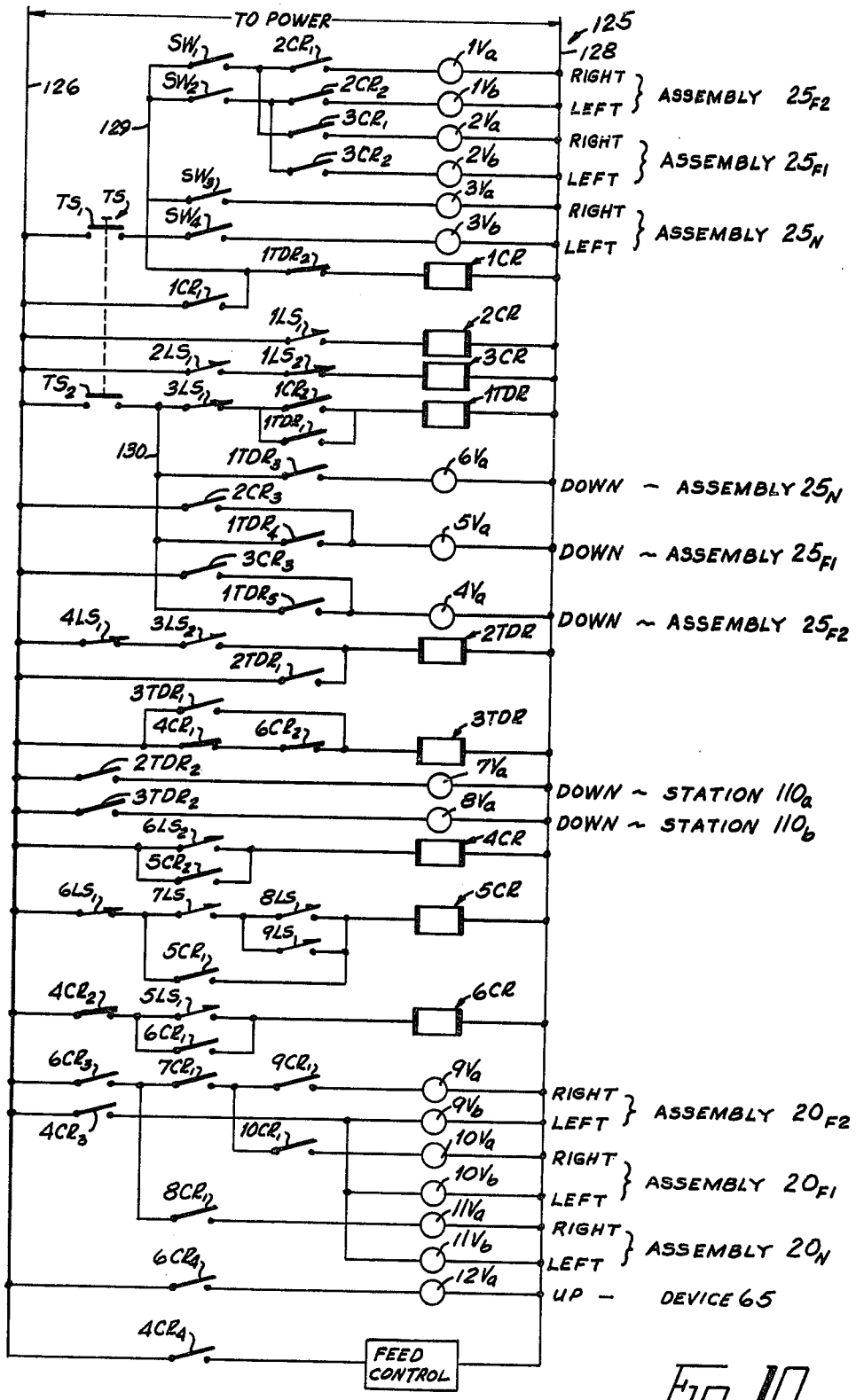
FIG. 10 is an electrical schematic for the invention.

As best seen in FIG. 10, the operational control circuit 125 for controlling the operation of the system is illustrated. Control circuit 125 includes a common hot wire 126 and a common ground wire 128. The normally open contact $TS_1$ of the trigger switch TS serves to connect the common hot wire 126 to a positioning hot wire 129. The right solenoid $\mathbf{1V}_a$ of valve 1V to the positioning cylinder 79 in the far end prepositioning stop assembly $\mathbf{25}_{F2}$ is connected to the positioning bar wire 129 through normally open contacts $\mathbf{2CR}_1$ of relay 2CR and the output switch $SW_1$ in controller 120. The left solenoid $\mathbf{1V}_b$ in valve 1V is connected to the positioning hot wire 129 through normally open contacts $\mathbf{2CR}_2$ of relay 2CR and the output switch $SW_2$ in controller 120. The right solenoid $\mathbf{2V}_a$ of the valve 2V for the positioning cylinder 79 in the far end prepositioning stop assembly $\mathbf{25}_{F1}$ is connected to the positioning hot wire 129 through the normally open contacts $\mathbf{3CR}_1$ of relay 3CR and the output switch $SW_1$ in controller 120 while the left solenoid $\mathbf{2V}_b$ of valve 2V is connected to the hot wire 129 through the normally open contacts 3CR of relay 3CR and the output switch $SW_2$ in controller 120. The right solenoid $\mathbf{3V}_a$ of the valve 3V to the positioning cylinder 79 in the near end prepositioning stop assembly $\mathbf{25}_N$ is connected to the hot wire 129 through the output switch $SW_3$ in controller 12 while the left solenoid $\mathbf{3V}_b$ thereof is connected to the hot wire 129 through the output switch $SW_4$ in controller 120. The coil of control relay 1CR is connected to the hot wire 129 through normally closed contacts $\mathbf{1TDR}_2$ of time delay relay 1TDR while normally open holding contacts $\mathbf{1CR}_1$ of relay 1CR in parallel across contacts $TS_1$ also connect the coil of relay 1CR to the hot wire 126 through the contacts $\mathbf{1TDR}_2$.

The coil of control relay 2CR is connected to the hot wire 126 through the normally open contacts $\mathbf{1LS}_1$ of the limit switch 1LS while the coil of control relay 3CR is connected to the common hot wire 126 through the normally closed contacts $\mathbf{1LS}_2$ of the limit switch 1LS and the normally open contacts $\mathbf{2LS}_1$ of limit switch 2LS. The control relays 2CR and 3CR are used to select which far end prepositioning stop assembly $\mathbf{25}_{F1}$ or $\mathbf{25}_{F2}$ will be used in conjunction with the near end prepositioning stop assembly $\mathbf{25}_N$ to position the cant in the prepositioning station 14. For instance, if the cant has a length such that limit switch 2LS is transferred but not limit switch 1LS, then solenoid 3CR is energized when contacts $\mathbf{2LS}_1$ close to close contacts $\mathbf{3CR}_1$ and $\mathbf{3CR}_2$ and permit the solenoids $\mathbf{2VA}_a$ and $\mathbf{2VA}_b$ to be energized through output switches $SW_1$ and $SW_2$ while contacts $\mathbf{2CR}_1$ and $\mathbf{2CR}_2$ remain open to prevent the solenoids $\mathbf{1V}_a$ and $\mathbf{1V}_b$ from being energized. On the other hand, when the cant is sufficiently long to transfer both limit switches 1LS and 2LS, contacts $\mathbf{1LS}_2$ will be opened and contacts $\mathbf{1LS}_1$ will be closed so that only control relay 2CR is energized. Thus, contacts $\mathbf{2CR}_1$ and $\mathbf{2CR}_2$ will be closed to allow the solenoids $\mathbf{1V}_a$ and $\mathbf{1V}_b$ to be energized with switches $SW_1$ and $SW_2$ while contacts $\mathbf{3CR}_1$ and $\mathbf{3CR}_2$ remain open so that solenoids $\mathbf{2V}_a$ and $\mathbf{2V}_b$ will not be energized. In this manner, the far end prepositioning stop assembly $\mathbf{25}_{F1}$ or $\mathbf{25}_{F2}$ closest to the far end of the cant will be used when the cant is being positioned in the prepositioning station 14. Thus, once the operator closes the trigger switch TS, he can move the handle 121 to selevtively operate the near end prepositioning stop assembly $\mathbf{25}_N$ and the enabled far end prepositioning stop assembly $\mathbf{25}_{F1}$ or $\mathbf{25}_{F2}$ to position the cant with respect to the guide light beams 24 and the positioning axis $A_p$.

The normally closed contacts $TS_2$ of the trigger switch TS connect the common hot wire 126 to the stop hot wire 130. The coil of time delay relay 1TDR is connected to the stop hot wire 130 through the normally open contacts $\mathbf{1CR}_2$ of relay 1CR and the normally closed contacts $\mathbf{3LS}_1$ of the limit switch 3LS in hold station $\mathbf{110}_a$. Contacts $\mathbf{1TDR}_1$ of time delay relay 1TDR are connected in parallel across contacts $\mathbf{1CR}_2$ so that the coil of relay 1TDR is also connected to hot wire 130 through contacts $\mathbf{1TDR}_1$ and contacts $\mathbf{4LS}_1$. The solenoid $\mathbf{6V}_a$ of the control valve $\mathbf{6}_V$ to the drop cylinder 86 in the near end prepositioning stop assembly $\mathbf{25}_N$ is connected to the hot wire 130 through the normally open contacts $\mathbf{1TDR}_3$ of time delay relay 1TDR. The solenoid $\mathbf{5V}_a$ of valve 5V to the drop cylinder 86 in the far end prepositioning stop assembly $\mathbf{25}_{F1}$ is connected to the hot wire 130 through the normally open contacts $\mathbf{1TDR}_4$ of time delay relay 1TDR and also to the common hot wire 126 through the normally open contacts $\mathbf{2CR}_3$ of control relay 2CR. The solenoid $\mathbf{4V}_a$ of valve 4V to the drop cylinder 86 in the far end prepositioning stop assembly $\mathbf{25}_{F2}$ is connected to the hot wire 130 through the normally open contacts $\mathbf{1TDR}_5$ and to the common hot wire 126 through the normally open contacts $\mathbf{3CR}_3$ of relay 3CR.

The time delay relay 1TDR is used to lower the stops 81 in the prepositioning stop assemblies 25 to release the cant from the prepositioning station 14 for movement on the feed chains 56 to the hold station $\mathbf{110}_a$. The control relays 2CR and 3CR are used to lower the stop 81 in that far end prepositioning stop assembly $\mathbf{25}_{F1}$ or $\mathbf{25}_{F2}$ not being used to position the cant in a prepositioning station 14. For instance, when the prepositioning stop assembly $\mathbf{25}_{F2}$ is to be used, contacts $\mathbf{2CR}_2$ will be closed as described above to energize solenoid $\mathbf{5V}_a$ and lower the stop 81 in the far end prepositioning stop assembly $\mathbf{25}_{F2}$ and when the far end prepositioning stop assembly $\mathbf{25}_{F1}$ is being used to position the cant in a prepositioning station 14, the contacts $\mathbf{3CR}_3$ will be closed as described above to energize solenoid $\mathbf{4V}_a$ and lower the stop 81 in the far end prepositioning stop assembly $25_{F2}$.

When the operator closes the trigger switch TS, contacts $TS_1$ will be closed to energize control relay 1CR through normally closed contacts $1TDR_2$. This closes the holding contacts $1CR_1$ to maintain the coil of relay 1CR energized as long as contacts $1TDR_2$ remain closed.

When the operator releases the trigger switch TS, the contacts $TS_2$ are closed. As soon as the hold station $110_a$ is cleared of the cant, the contacts $4LS_1$ close so that the coil of relay 1TDR is energized. Relay 1TDR is selected so that its contacts are transferred when the coil is energized but then returned to their normal positions after a prescribed length of time. The length of time selected for the contacts to remain transferred is such that the cant in the prepositioning station 14 has been moved sufficiently by the feed chains 56 to clear the stops 81 in the prepositioning stop assemblies 25. As soon as the coil of relay 1TDR is energized, it will be seen that the contacts $1TDR_2$ open to de-energize the relay 1CR and open contacts $1CR_2$. Contacts $1TDR_1$, however, are closed to keep the coil of relay 1TDR energized. Energizing the coil of relay 1TDR also closes the contacts $1TDR_3$–$1TDR_5$ so that all of the stops 81 in the prepositioning stop assemblies 25 are lowered to release the cant for movement by the feed chains 56 along the conveying path $P_C$. After the relay 1TDR times out, all of its contacts are returned to their normal positions so that all of the stops 81 in the prepositioning stop assemblies 25 are returned to their arresting positions for the receipt of the next cant in the prepositioning station 14.

The coil of time delay relay 2TDR is connected to the common hot wire 126 through the normally open contacts $3LS_2$ of limit switch 3LS in hold station $110_a$ and the normally closed contacts $4LS_1$ of the limit switch 4LS in hold station $110_b$. The coil of relay 2TDR is also connected to hot wire 126 through normally open holding contacts 2TDR of relay 2TDR to keep the coil of relay energized until it times out.

The coil of relay 3TDR is connected to the hot wire 126 by normally closed contacts $4CR_1$ of relay 4CR and normally closed contacts $6CR_2$ of relay 6CR. The coil of relay 3TDR is also connected to the hot wire 126 through normally open holding contacts $3TDR_1$ of relay 3TDR to keep relay 3TDR energized until it times out.

The solenoid $7V_a$ of valve 7V to the fluid cylinders 114 in the hold station $110_a$ is connected to hot wire 126 through normally open contacts $2TDR_2$ of relay 2TDR. The solenoid $8V_a$ of valve 8V to the fluid cylinders 114 in the hold station $110_b$ is connected to hot wire 126 through normally open contacts $3TDR_2$ of relay 3TDR.

The coil of control relay 4CR is connected to hot wire 126 through the normally open contacts $6LS_2$ of limit switch 6LS and through the normally open contacts $5CR_2$ of control relay 5CR in parallel across the contacts $6LS_2$. The coil of control relay 5CR is connected to the hot wire 126 through the normally closed contacts $6LS_1$ of limit switch 6LS, the normally open limit switch 7LS, and the normally open limit switches 8LS and 9LS in parallel with each other. Normally open holding contacts $5CR_1$ of relay 5CR are connected in parallel across the limit switches 7LS–9LS to maintain the coil of relay 5CR energized through contacts $6LS_1$. The coil of relay 6CR is connected to the hot wire 126 through normally open contacts $5LS_1$ of limit switch 5LS and normally closed contacts $4CR_2$ of control relay 4CR. Holding contacts $6CR_1$ are connected in parallel across the contacts $5LS_1$ to keep the coil of relay 6CR energized through contacts $4CR_2$.

The relay 2TDR is used to control the release of a cant held in the hold station $110_a$ for movement to hold station $110_b$. When a cant is present in hold station $110_a$, it will be seen that contacts $3LS_1$ of limit switch 3LS will be closed. When a cant has cleared the hold station $110_b$, the contacts $4LS_2$ in limit switch 4LS will be closed so that the coil of relay 2TDR will be energized to close contacts $2TDR_1$ and maintain the coil of relay 2TDR energized for a prescribed period of time. When the coil of relay 2TDR is energized, the contacts $2TDR_2$ close to energize the solenoid $7V_a$ of the valve 7V to cause the stops 112 in the hold station $110_a$ to be lowered and thus release the cant so that the feed chains 56 can move the cant along the conveying path $P_C$ toward the hold station $110_b$. The relay 2TDR is selected to time out after a sufficient period of time for the cant to clear the stops 112 in the hold station $110_a$ whereupon the contacts $2TDR_2$ are opened to de-energize the solenoid $7V_a$ and again raise the stops 112 in the hold station $110_a$ to arrest the movement of the next cant moving into station $110_a$.

The control relays 4CR–6CR together with the relay 3TDR are used to control the operation of the hold station $110_b$. This portion of the circuit is designed so that, as long as a cant is within the infeed unit 15, the next cant will be held in the hold station $110_b$. This operation will best be understood after consideration of the infeed stop asemblies 20.

The right solenoid $9V_a$ on valve 9V controlling the stop cylinder 101 in the far end infeed stop assembly $20_{F2}$ is connected to hot wire 126 through the normally open contacts $6CR_3$ of relay 6CR, the normally open contacts $7CR_1$ of control relay 7CR and the normally open contacts $9CR_1$ of control relay 9CR. The right solenoid $10V_a$ on valve $10_V$ controlling the stop cylinder 101 in the far end infeed stop assembly $20_{F1}$ is connected to hot wire 126 through contacts $6CR_3$, the contacts $7CR_1$ and the normally open contacts $10CR_1$ of control relay 10CR. The right solenoid $11V_a$ on valve 11V controlling the near end infeed stop assembly $20_N$ is connected to the hot wire 126 through contacts $6CR_3$ and the normally open contacts $8CR_1$ of control relay 8CR. The left solenoids $9V_b$, $10V_b$ and $11V_b$ are all connected to hot wire 126 through normally open contacts $4CR_3$.

The control relays 7CR–10CR are all in the memory control circuit 140 as will be further described. The control relays 9CR and 10CR are used to select which of the far end infeed stop assemblies $20_{F1}$ and $20_{F2}$ will be used to position the cant in the infeed unit 15. The control relays 7CR and 8CR are respectively used to control the position of the far end and near end of the cant with respect to the edging path $P_E$ in the infeed unit 15.

The solenoid $12V_a$ of valve 12V to the lift devices 65 is connected to the hot wire 126 through normally open contacts $6CR_4$ of relay 6CR. The feed control circuit for the infeed unit 15 is connected to hot wire 126 through the normally open contacts $4CR_4$.

The operation of the hold station $110_b$ can now be described. When the infeed unit 15 is clear of a cant, the contacts $4CR_1$ and $6CR_2$ will be closed so that the coil of relay 3TDR will be energized to close contacts $3TDR_1$ and $3TDR_2$. This energizes the solenoid $8V_a$ of control valve 8V to lower the stops 112 in the hold station $110_b$ and allows the cant to be moved by the feed chains 56 along the conveying path $P_C$ toward the infeed unit 15. As soon as the cant from hold station $110_b$ engages the limit switch 5LS, the relay 6CR is energized to open contacts $6CR_2$. However, contacts $3TDR_1$ keep relay 3TDR energized until it times out. Contacts $6CR_2$ remain open until relay 4CR is energized whereupon contacts $6CR_2$ close but contacts $4CR_1$ are opened. Thus, it will be seen that either contacts $6CR_2$ or $4CR_1$ are open while a cant is in the infeed unit 15 to prevent the relay 3TDR from being re-energized to lower stops 112 in hold station $110_b$. The relay 3TDR selected to time out after the cant has had a sufficient time to pass the stops 112 in the hold station $110_b$ whereupon the contacts $3TDR_2$ are opened to de-energize solenoid $8V_a$ and again raise the stops 112 in the hold station $110_b$. Thus, the next cant moving into the hold station $110_b$ will be arrested by the raised stops 112.

As the released cant from hold station $110_b$ moves toward the infeed unit 15 on the feed chains 56, it engages the limit switch 5LS as it enters the infeed unit 15. This causes the relay 6CR to be energized to close contacts $6CR_1$ and maintain relay 6CR energized after the cant clears the switch 5LS. At the same time, contacts $6CR_2$ are opened to prevent the relay 3TDR from being reenergized. Energizing relay 6CR closes contacts $6CR_4$ to energize solenoid $12V_a$ to cause the lift devices 65 to raise the pivot rails 51 so that the feed chains 56 move the cant into the infeed unit 15 over the infeed chains 61. As soon as relay 6CR is energized, contacts $6CR_2$ are closed to permit the solenoids $9V_a$–$11V_a$ to be operated from the memory circuit 140 as will be more fully expalined to extend the stops 104 in the infeed stop assemblies 20 to position the incoming cant with respect to the eding path $P_E$ as will become more apparent. As soon as the leading edge of the cant abuts the stop 104 in the near end positioning assembly $20_N$ and the stop 104 in the far end infeed stop assembly $20_{F1}$ or $20_{F2}$ being used to position the cant, the limit switch 7LS on the near end infeed stop assembly $20_N$ is closed and the limit switch 8LS or 9LS on the far end positioning assembly $25_{F1}$ or $25_{F2}$ being used to position the cant is also closed. This energizes the coil of relay 5CR to close contacts $5CR_1$ across switches 7LS–9LS to maintain relay 5CR energized until contacts $6LS_1$ in limit switch 6LS are opened as will become more apparent. At the same time, contacts $5CR_2$ are closed to energize relay 4CR. This causes the contacts $4CR_2$ to open and de-energize relay 6CR to open contacts $6CR_3$ and disable the right solenoids $9V_a$–$11V_a$ to the infeed stop assemblies 20. De-energizing relay 6CR also opens contacts $6CR_4$ to de-energize solenoid $12V_a$ to lower the lift devices 65 and deposit the cant onto the infeed chains 61. At the same time, contacts $4CR_3$ close to energize the left solenoids $9V_b$–$11V_b$ and cause all of the stops 104 in the infeed stop assembly 20 to be moved to the left away from the edging path $P_E$ as will become more apparent. It will be noted that relay 4CR remains energized to keep contacts $4CR_1$ open and prevent relay 3TDR from being re-energized.

Energizing relay 4CR also closes contacts $4CR_4$ to activate the feed control circuit 132 associated with the infeed unit 15 to cause the infeed unit 15 to lower the hold down rolls 68 and the infeed unit 15 to feed the cant into the edger 16 in conventional manner. As the cant moves out of the discharge end of the infeed unit 15, it transfers the limit switch 6LS to open contacts $6LS_1$ to de-energize relay 5CR while at the same time closes contacts $6LS_2$ to keep solenoid 4CR energized. Thus, the feed control circuit 132 continues to operate the infeed unit 15 in conventional manner until the cant has cleared the limit switch 6LS. Because limit switch 6LS is maintained in a transferred position as long as the cant is passing out of the infeed unit 15, the relay 3TDR is prevented from being energized since contacts $4CR_1$ remain open.

As soon as the cant clears the infeed unit 15 and the limit switch 6LS, contacts $6LS_2$ to de-energize relay 4CR allowing contacts $4CR_1$ to close so that relay 3TDR is re-energized to lower the stops 112 in the hold station $110_b$ and allow the next cant to proceed into the infeed unit 15. At the same time, the contacts $4CR_2$ are closed so that the relay 6CR can be again energized when the limit switch 5LS is closed by the cant passing into the infeed unit 15. Also, when relay 4CR is de-energized, contacts $4CR_3$ are opened to de-energize the solenoids $9V_b$–$11V_b$ and the contacts $4CR_4$ are opened to cause the feed control circuit 132 to raise the hold down rolls 68 for the receipt of another cant therein.

As soon as the limit switch 6LS is cleared, it will be seen that the cant at the hold station $110_b$ will be moved into the infeed unit 15 and the operation repeated. As soon as the cant in the hold station $110_b$ clears that station, the next cant in the hold station $110_a$ will be moved into the hold station $110_b$. Likewise, as soon as the cant in the hold station $110_a$ clears that station, the stops in the prepositioning stop assemblies 25 can be lowered after the cant has been prepositioned therein to allow the can to move into the hold station $110_a$.

Figure 11:
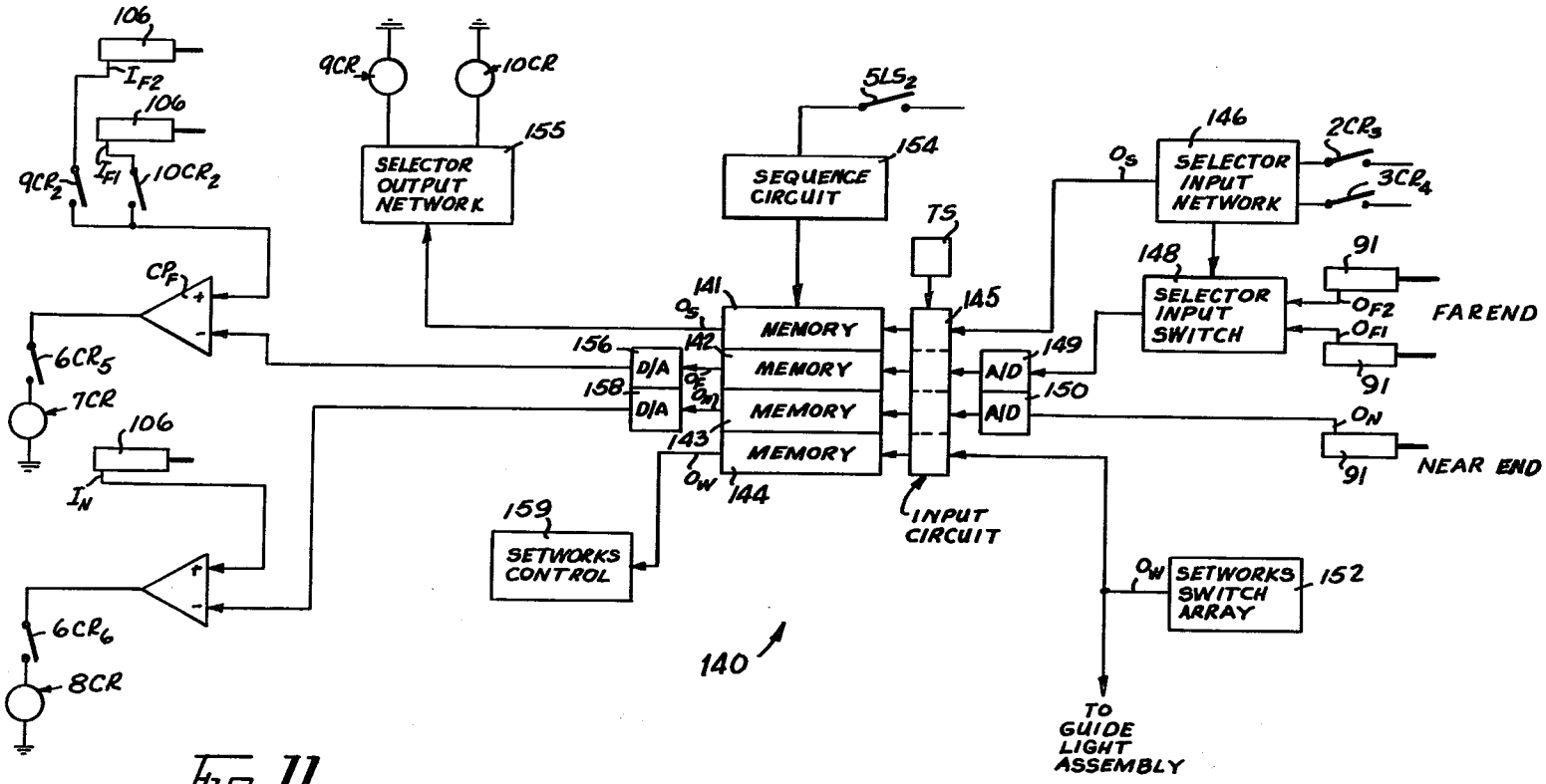
FIG. 11 is a functional electrical schematic illustrating the memory control circuit of the invention.

The memory control circuit is schematically illustrated functionally in FIG. 11. The memory control circuit 140 serves to sense the position of the prepositioning stop assemblies 25 for each cant and then set the infeed stop assemblies 20 when that cant reaches the infeed unit 15 so that the infeed stop assemblies 20 will position the cant in the infeed unit 15 so that the imaginary positioning axis $A_p$ located on the cant in the prepositioning station 14 will be located in alignment with the edging path $P_E$ in the infeed unit 15. The memory control circuit 140 includes a selection memory 141, a far end position memory 142, a near end position memory 143, and a setworks memory 144. Each of the memories 141–144 has the capability of storing multiple successive inputs and for outputting these stored values successively in the same order in which they were inputted into the memory. The inputs to the memories 141–144 are controlled by an input circuit 145 controlled by the trigger switch TS so that the information is transferred into the inputs of the members 141–144 when the operator releases the trigger switch TS.

The input to the selector memory 141 through the input circuit 145 is provided by selector input network 146. The selector input network 146 is controlled by the normally open contacts $2CR_3$ from the control relay 2CR in the control circuit 125 and the normally open contacts $3CR_4$ of the control relay 3CR in the control circuit 125. When contacts $2CR_3$ are closed, the output $O_S$ of the selector input network 146 to the memory 141 through the input circuit 145 will indicate that the far end prepositioning stop assembly $25_{F2}$ is being used. On the other hand, when the contacts $3CR_4$ are closed, the output $O_S$ of the selector input network 146 indicates that the far end prepositioning stop assembly $25_{F1}$ is being used.

The output $O_{F2}$ from the transducer 106 in the far end prepositioning stop assembly $25_{F2}$ and the output $O_{F1}$ of the transducer 106 in the far end prepositioning stop assembly $25_{F1}$ are connected to a selector input switch 148. The selector input switch 148 is controlled by the selector input network 146 so that, when the far end prepositioning stop assembly $25_{F2}$ is being used to position the cant, the selector input switch 148 connects the output $O_{F2}$ to the input of the far end memory 142 through the input circuit 145 and, when the far end prepositioning stop assembly $25_{F1}$ is being used to position the cant, the selector input switch 148 connects the output $O_{F1}$ to the input of the far end memory 142 through the input circuit 145. Because the outputs $O_{F2}$ and $O_{F1}$ are analog values, these outputs may be converted into digital values by the analog-to-digital converter 149 for storage in memory 142. The output $O_N$ of the transducer 106 in the near end prepositioning stop assembly $25_N$ is connected to the input of the near end memory 143 through the analog-to-digital converter 150 and the input circuit 145.

The control module 21 includes a setworks switch array 152 which permits the operator to select the setting at which the cant is to be edged. The setworks switch array 152 is conventional and will not be described in detail. The output $O_N$ of the setworks switch array 152 is connected to the guide light assembly 22 to cause the guide light assembly to space the light beams 24 on opposite sides of the positioning axis $A_P$ corresponding to the positions at which the side cutters 18 and 19 will be spaced when the cant is edged. The output of the setworks switch array 152 is also connected to the setworks memory 144 through the input circuit 145.

The operator depresses the trigger switch TS on the control handle 121 and uses the control handle 121 to operate the prepositioning stop assemblies 25 until the cant in the prepositioning station 14 is oriented so that the guide light beams 24 lie inside the wanes on the cant and thus establish the positioning axis $A_P$ on the cant at which the cant is to be aligned in the infeed unit 15. At this time, the contacts $2CR_3$ or $3CR_4$ are closed to indicate which of the far end prepositioning stop assemblies $25_{F1}$ of $25_{F2}$ are being used. The output $O_{F2}$ or $O_{F1}$ from the transducer 91 of the far end prepositioning stop assembly being used is indicative of the distance $d_a$ between the leading edge 90 on stop 81 of that far end prepositioning stop assembly being used and axis $A_P$. The output $O_N$ of the transducer 91 on the near end prepositioning stop assembly $25_N$ is indicative of the distance $d_a$ between the leading edge 90 on the stop 81 of that prepositioning stop assembly and the positioning axis $A_P$. Since the operator has already manipulated the setworks switch array 152, is output $O_W$ is indicative of the setting of the guide light assembly 22.

When the operator releases the trigger switch TS after the cant is positioned with respect to axis $A_P$, the output $O_S$ from the selector input network 146 is transferred into the memory 141, the output $O_{F2}$ or $O_{F1}$ from the selector input switch 148 is transferred into the memory 142, the output $O_N$ is transferred into the memory 143, and the output from the setworks switch array 152 is transferred into the setworks memory 144. The memories 141–144 are such that the information transferred into these memories will be held in the memory and transferred out of the memory in the same order in which it is received. Thus, the information with respect to each cant will be transferred out of each of the memories 141–144 in the same order in which it is received. After the cant in the prepositioning station 14 has been released and moves toward the infeed unit 15, the operator can then move another cant from the turning unit 11 into position in the prepositioning station 14 and orient it. When the operator completes the prepositioning of the cant in the station 14, the trigger switch TS is again released and that information transferred into the memories 141–144.

The information stored in the memories 141–144 is stepped through these memories by a sequence circuit 154 controlled by the normally opened contacts $5LS_2$ of the limit switch 5LS. Each time the contacts $5LS_2$ are closed, the sequence circuit 154 causes the information corresponding to that cant entering feed unit 15 to be generated at the outputs of the memories 141–144. This causes the information with respect to each of the cants to be outputted out of the memories 141–144 in the same order in which it is inputted into the memories 141–144. Thus, when each cant which has been prepositioned in the prepositioning station 14 passes into the infeed unit 15 to momentarily close the contacts $5LS_2$, the information corresponding to that cant will be generated at the outputs of the memories 141–144.

The output $O_S$ from the selector memory 141 is connected to a selector output network 155 which operates the coils of relays 9CR and 10CR. When the output $O_S$ indicates that the far end prepositioning stop assembly $25_{F2}$ was used to preposition the cant, the selector output network 155 energizes the relay 9CR and when the output $O_S$ indicates that the far end prepositioning stop assembly $25_{F1}$ was used to preposition the cant, the selector output network 155 energizes relay 10CR. As described hereinbefore, it will be appreciated that the normally open contacts $9CR_1$ serve to enable the solenoid $9V_a$ of the control valve 9V to the stop cylinder 101 in the far end infeed stop assembly $20_{F2}$ while the normally open contacts $10CR_1$ of the relay 10CR serve to enable the solenoid $10V_a$ of the control valve 10V to the stop cylinder 101 in the far end infeed stop assembly $20_{F1}$.

The output $O_F$ of the far end memory 142 is connected through a digital-to-analog converter 156, which serves to convert the output $O_F$ back into an analog value, to one input on a far end comparator $CP_F$. The other input to the comparator $CP_F$ is connected to the output $I_{F2}$ of the transducer 106 in the far end infeed stop assembly $20_{F2}$ through the normally open contacts $9CR_2$ of relay 9CR, and to the output $I_{F1}$ of the transducer 106 in the far end infeed stop assembly $20_{F1}$ through the normally open contacts $10CR_2$ of relay 10CR. Thus, if the prepositioning stop assembly $25_{F2}$ was used to preposition the cant in the prepositioning station 14, the contacts $9CR_2$ will be closed to connect the output $I_{F2}$ to the other input of the comparator $CP_F$, but if the far end prepositioning stop assembly $25_{F1}$ was used to position the cant in the prepositioning station 14, the contacts $10CR_2$ will be closed to connect the output $I_{F1}$ to the other input of the comparator $CP_F$.

The output of the comparator $CP_F$ is connected to the coil of control relay 7CR through normally open contacts $6CR_5$ of relay 6CR. Thus, when the cant enters the infeed unit 15 to activate the limit switch 5LS and energize relay 6CR, contacts $6CR_5$ close to connect the output of comparator $CP_F$ to relay 7CR. The comparator $CP_F$ compares the value of the selected output $I_{F1}$ or $I_{F2}$ with the output $O_F$ from memory 142 and generates an output until the value of the selected output $I_{F1}$ or $I_{F2}$ equals the value of output $O_F$. Thus, when contacts $6CR_5$ close, relay 7CR will be energized to close contacts $7CR_1$ and move the stop 104 in the selected far end infeed stop assembly $20_{F1}$ or $20_{F2}$ toward the edging path $P_E$ until the selected output $I_{F1}$ and $I_{F2}$ equals the output $O_F$ and stops stop 104 in that position. It will be appreciated that the output $O_F$ is equal in value to that of the output $O_{F1}$ and $O_{F2}$ of the transducer 91 in the far end prepositioning stop assembly $25_{F1}$ and $25_{F2}$ used to preposition the cant in station 14 at the time when the cant was prepositioned with respect to the positioning axis $A_P$. Because of this, it will be seen that the stop 104 in the selected for end infeed stop assembly $20_{F1}$ or $20_{F2}$ will be located by the comparator $CP_F$ so that the leading edge 105 thereon is spaced distance $d_b$ from the edging path $P_E$ which is equal to distance $d_a$ that the leading edge 90 on the stop 81 in the assembly $25_{F1}$ or $25_{F2}$ was located from axis $A_P$ when the cant was prepositioned in station 14. Since the leading edge of the cant abuts edge 105 on stop 14 at the same position as it did the edge 90 on stop 81, the far end of the cant will be located so that the far end of the axis $A_P$ established on the cant is located in registration with the edging path $P_E$ by the infeed stop assembly $20_{F1}$ or $20_{F2}$.

The output $O_N$ of the near end memory 143 is connected through a digital-to-analog converter 158, which serves to convert the output $O_N$ back into an analog value, to one input of a near end comparator $CP_N$. The other input of comparator $CP_N$ is connected to the output $I_N$ of the transducer 106 in the near end infeed stop assembly $20_N$. The output of the comparator $CP_N$ is connected to the coil of relay 8CR through normally open contacts $6CR_6$ of relay 6CR. Comparator $CP_N$ compares the value of output $I_N$ with output $O_N$ and generates an output until the value of output $I_N$ equals output $O_N$. Thus, when contacts $6CR_6$ close, relay 8CR will be energized to close contacts 8CR, and move the stop 104 in the near end infeed stop assembly $20_N$ toward the edging path $P_E$ until the output $I_N$ equals the output $O_N$ and stops stop 104 in that position. It will be appreciated that the output $O_N$ is equal in value to that of the output $O_N$ of the transducer 91 in the rear end prepositioning stop assembly $25_N$ used to preposition the cant in station 14 at the time when the cant was prepositioned with respect to the positioning axis $A_P$. Because of this, it will be seen that the stop 104 in the near end infeed stop assembly $20_N$ will be located by the comparator $CP_N$ so that the leading edge 105 thereon is spaced distance $d_b$ from the edging path $P_E$ which is equal to distance $d_a$ that the leading edge 90 on the stop 81 in the assembly $25_N$ was located from axis $A_P$ when the cant was prepositioned in station 14. Since the leading edge of the cant abuts edge 105 on stop 14 at the same position as it did edge 90 on stop 81, the near end of the cant will be located so that the near end of the axis $A_P$ established on the cant is located in registration with the edging path $P_E$ by the infeed stop assembly $20_N$.

The action of the infeed stop assemblies 20, then, serves to arrest the movement of the cant so that the can will be located with respect to the edging path $P_E$ the same as it was located with respect to the positioning axis $A_P$ in the prepositioning station 14. When the cant is then fed into the edger 16 with the cutters 18 and 19 on the same setting as the guide light beams 24 when the cant was prepositioned, the cant will be edged along the same paths indicated by the guide light beams 24.

The output $O_W$ from the setworks memory 144 is connected to the setworks controller 159 of the edger 16. The operation of controller 159 is conventional and is responsive to output $O_W$ to adjust the spacing of the cutters 18 and 19 to be the same as that of the guide light beams 24 from the guide light assembly 22 in prepositioning station 14 when the cant in the infeed unit 15 was prepositioned.

When the next incoming cant passes into the infeed unit 15 and closes contacts $5LS_2$ to activate the sequence circuit 154, the information in the memories 141–144 for that cant is stepped forward and outputted in outputs $O_S$, $O_F$, $O_N$ and $O_W$ while the information already used to orient the cant being edged in edger 16 is cleared from the memories. In this manner, the preposition information with respect to each cant is held in the memories and then used to position that cant in the infeed unit 15. It is to be understood that different memory configurations may be used for this purpose.

In summary, the operator causes a cant to be transferred from the turning unit 11 onto the jump chains 44 in the turning section 36 of feed table 12. The cant is moved onto the feed chains 56 in the central section 35 of feed table 12 which move the cant to the prepositioning station 14 where its movement is arrested by the prepositioning stop assemblies 25. The limit switches 1LS and 2LS automatically enable the far end prepositioning stop assembly $25_{F1}$ or $25_{F2}$ closest to the far end of the cant.

The operator selects the setting of the guide light assembly 22 appropriate for the cant to be edged and then depresses the trigger switch TS on the controller 120. He then moves the handle 121 on controller 120 to operate the prepositioning stop assemblies 25 until the guide light beams 24 lie just inside the wanes on the cant. The spacing between light beams 24 may be changed as necessary during this process. After the cant has been prepositioned with respect to the guide light beams 24 and positioning axis $A_P$, the trigger switch TS is released.

The rest of the operation is now automatically controlled. When the trigger switch TS is released, the selection signal $O_S$ is inputted into memory 141, the far end signal $O_{F1}$ or $O_{F2}$ is inputted into memory 142, the near end signal $O_N$ is inputted into memory 143 and the setworks signal $O_W$ is inputted into memory 144 for storage. At the same time, the stops 81 in assemblies 25 are lowered if the hold station $110_a$ is clear of a cant and the feed chains 56 move the cant to hold station 110a. At this time, the operator can transfer another cant from the turning unit 11 onto feed table 12 and start prepositioning it.

As soon as hold station 110b is clear of a cant, the cant in station 110a is released and moved to station 110b by chains 56. As soon was the infeed unit 15 is clear of a cant, the hold station 110b releases the cant and feed chains 56 move it toward the infeed unit 15. When the cant transfers limit switch 5LS, entering the infeed unit 15, the sequence circuit 154 outputs the stored preposition signals in memories 141–144 for that cant while the lift devices 65 are raised so that the feed chains 56 move the cant over the infeed chains 61. At the same time, the infeed stop assemblies 20 are energized. The outputs $O_S$ from memory 141 selects that far end infeed stop assembly $20_{F1}$ or $20_{F2}$ corresponding to the stop assembly $25_{F1}$ or $25_{F2}$ used to preposition the cant while output $O_F$ extends the stop 104 thereof until it is located the same distance from edging path $P_E$ as the corresponding stop 81 was located from axis $A_P$ when the cant was preoriented. Output $O_N$ extends stop 104 in infeed stop assembly $20_N$ until it is located the same distance from path $P_E$ as the corresponding stop 81 was located from axis $A_P$ when the cant was preoriented. Output $O_W$ causes the setworks control 159 to set the cutters 18 and 19 in edger 16 at the same spacing as guide light beams 24 when the cant was preoriented. With the stops 104 on the infeed stop assemblies 20 in their extended positions, the feed chains 56 move the cant up against the stops so that its movement is arrested with the cant oriented at the same position with respect to the edging path $P_E$ that it had with respect to the positioning axis $A_P$ when it was prepositioned in the prepositioning station 14. When limit switch 7LS and limit switch 8LS or 9LS is transferred, the cant is lowered onto the infeed chains 61 and the infeed unit 15 feeds the cant into the edger while maintaining the orientation of the cant with respect to the edging path $P_E$ so that the cutters 18 and 19 edge the cant as indicated by the guide light beams 24 in the prepositioning station 14.

The hold stations 110*a* and 110*b* allow the prepositioned cants to be accumulated and fed to the infeed unit 15 so that the processing speed is maximized. Because the memories 141–144 are capable of storing multiple signals and these signals are sequenced out of the memories in the same order as received as limit switch 5LS is successively transferred, the signals generated when the particular cant was prepositioned will be used to orient that cant in the infeed unit 15.

What is claimed as invention is:

1. A method of orienting a cant on the infeed unit of an edger comprising the steps of:

moving the cant to a positioning station remote to the infeed unit;

arresting the movement of the cant in the positioning station;

superimposing on the cant a plurality of parallel, spaced apart, guide light beams corresponding to the paths along which the edger will trim the cant to form dimensioned lumber;

shifting the cant with respect to the guide light beams with a pair of spaced apart, manually controlled positioning mechanisms until the guide light beams lie inside the longitudinally extending wanes on opposite sides of the cant to orient the cant;

sensing the position of each of the positioning mechanisms when the cant is oriented;

storing the sensed position of each of the positioning mechanisms;

moving the cant into the infeed unit;

engaging the cant with a pair of spaced apart infeed stops at spaced apart positions corresponding to the positions at which the positioning mechanisms engaged the cant;

positioning each of the infeed stops according to the stored sensed position of the corresponding positioning mechanism to locate the cant on the infeed unit so that the infeed unit will feed the cant into the edger to cause the edger to trim the cant along the paths of the guide light beams at the positioning station when the cant was oriented.

2. The method of claim 1 further including the step of setting the side cutters in the edger on the same spacing as that of the guide light beams superimposed on the cant prior to the infeed unit feeding the cant into the edger.

3. The method of claim 1 further including the steps of adjustably positioning the spacing between the guide light beams so that the guide light beams will lie just inside the wanes on the cant in the positioning station; sensing the spacing between the guide light beams, storing the sensed spacing of the guide light beams; and setting the spacing between the side cutters in the edger according to the stored sensed spacing of the guide light beams prior to the infeed unit feeding the cant into the edger so that the edger will trim the cant along the paths of the light beams superimposed thereon at the positioning station when the cant was oriented.

4. A system for orienting cants for edging by the side cutters in an edger comprising:

an infeed unit for moving the cant into the edger along a prescribed edging path;

manually controllable positioning means remotely of said infeed unit for selectively positioning the cant with respect to a positioning axis to preorient the cant with respect to the positioning axis;

sensing means operatively connected to said positioning means for sensing the position of the cant with respect to said positioning axis when said cant is preoriented with respect to said positioning axis;

memory means operatively connected to said sensing means for storing the sensed position of the cant with respect to said positioning axis;

conveying means for selectively moving said cant from said positioning means to said infeed unit;

infeed stop means operatively connected to said memory means for controlling the position of the cant in said infeed unit with respect to the edging path, said infeed stop means responsive to the sensed position stored in said memory means to position the cant with respect to the edging path with the same orientation the cant had with respect to the positioning axis when the cant was preoriented.

5. The system of claim 4 further including adjustment means for selectively adjusting the spacing between said guide light beams in prescribed increments and generating a setworks signal indicative of the spacing between said guide light beams; wherein said memory means is operatively connected to said adjustment means for storing the setworks signal; and further including setworks control means operatively connected to said memory means and responsive to the stored setworks signal to adjust the spacing between the side cutters in the edger to equal the spacing between the guide light beams prior to said infeed unit moving the cant into the edger.

6. The system of claim 4 further including holding means for selectively arresting movement of the cant by said conveying means between said positioning means and said infeed unit and control means for causing said holding means to arrest the motion of the cant until the next preceding cant has been moved out of said infeed unit into the edger.

7. The system of claim 6 wherein said memory means has the capability of storing the sensed position of a plurality of the cants and further including sequencing means operatively connected to said memory means for causing the sensed position of each cant with respect to the positioning axis to be used by said infeed stop means to position the cant with respect to the edging path in said infeed unit.

8. The system of claim 4 wherein said positioning means includes first and second apart prepositioning stop assemblies adapted to engage the leading edge of the cant adjacent the opposite ends of the cant to position the cant with respect to said positioning axis; wherein said sensing means includes a first sensing mechanism operatively connected to said first prepositioning stop assembly for generating a first sensed signal indicative of the distance between the leading edge of the cant at said first prepositioning stop assembly and said positioning axis and a second sensing mechanism operatively connected to said second prepositioning stop assembly for generating a second sensed signal indicative of the distance between the leading edge of the cant at said second prepositioning stop assembly and said positioning axis; wherein said memory means includes a first memory operatively connected to said first sensing mechanism to store said first sensed signal and a second memory operatively connected to said second sensing mechanism to store said second sensed signal; and wherein said infeed stop means includes a first infeed stop assembly for engaging the leading edge of the cant at the same position as said first prepositioning stop assembly and responsive to the first sensed signal stored in said first memory to position the leading edge of the cant at said first infeed stop assembly the same distance from the edging path that the leading edge of the cant at said first prepositioning stop assembly had with respect to said positioning axis, and a second infeed stop assembly for engaging the leading edge of the cant at the same position as said second prepositioning stop assembly and responsive to the second sensed signal stored in said second memory to position the leading edge of the cant at said second infeed stop assembly at the same distance from the edging path that the leading edge of the cant at said second prepositioning stop assembly had with respect to said positioning axis.

9. The system of claim 4 wherein said positioning means includes a plurality of prepositioning stop assemblies adapted to engage the cant at spaced apart positions along the length of the cant and first selection means for causing those prepositioning stop assemblies closest to the opposite ends of the cant to engage the cant for selectively positioning the cant with respect to the positioning axis while preventing the other of said prepositioning stop assemblies from engaging the cant; further including detection means for generating a detection signal indicative of which of said prepositioning stop assemblies are engaging the cant; wherein said memory means is operatively connected to said detection means for storing the detection signal; and wherein said infeed stop means includes a plurality of infeed stop assemblies adapted to engage the cant at positions corresponding to said prepositioning stop assemblies and second selection means responsive to the stored detection signal to cause those infeed stop assemblies corresponding to those prepositioning stop assemblies which were used to position the cant with respect to the positioning axis to engage and position the cant with respect to the edging path while preventing the other of said infeed stop assemblies from engaging the cant.

* * * * *